US011276966B1

(12) United States Patent
Costello et al.

(10) Patent No.: US 11,276,966 B1
(45) Date of Patent: Mar. 15, 2022

(54) HIGH DENSITY COMMUNICATION SYSTEM

(71) Applicant: TE Connectivity Services GmbH, Schaffhausen (CH)

(72) Inventors: Brian Patrick Costello, Scotts Valley, CA (US); Clarence Leon Yu, Sacramento, CA (US)

(73) Assignee: TE CONNECTIVITY SERVIVES GmbH, Schaffhausen (CH)

( * ) Notice: Subject to any disclaimer, the term of this patent is extended or adjusted under 35 U.S.C. 154(b) by 0 days.

(21) Appl. No.: 17/021,459

(22) Filed: Sep. 15, 2020

(51) Int. Cl.

| | |
|---|---|
| ***H01R 9/03*** | (2006.01) |
| ***H01R 13/6587*** | (2011.01) |
| ***H01R 13/6471*** | (2011.01) |
| ***H01R 13/514*** | (2006.01) |
| ***H01R 12/71*** | (2011.01) |
| ***H01R 12/72*** | (2011.01) |

(52) U.S. Cl.
CPC ..... *H01R 13/6587* (2013.01); *H01R 12/716* (2013.01); *H01R 12/724* (2013.01); *H01R 13/514* (2013.01); *H01R 13/6471* (2013.01)

(58) Field of Classification Search
CPC .... H01R 12/57; H01R 12/716; H01R 12/718; H01R 12/72; H01R 12/724; H01R 13/514; H01R 13/6471; H01R 13/6587
USPC ..... 439/59, 79, 607.07
See application file for complete search history.

(56) References Cited

U.S. PATENT DOCUMENTS

| | | | | |
|---|---|---|---|---|
| 9,065,230 | B2 | 6/2015 | Milbrand, Jr. | |
| 10,547,133 | B1 * | 1/2020 | Consoli | G02B 6/4277 |
| 2021/0126392 | A1 * | 4/2021 | Briant | H01R 12/78 |

* cited by examiner

*Primary Examiner* — Khiem M Nguyen

(57) ABSTRACT

A pluggable module includes a pluggable body extending between a cable end and a mating end rearward of the cable end. The pluggable body has a module cavity. The pluggable module includes a module circuit board received in the module cavity. The module circuit board has a mating edge at a mating end configured to be plugged into a first slot of a communication connector. The pluggable module includes a plug connector extending between a plug mating end and a plug mounting end. The plug mounting end is mounted to the module circuit board. The plug connector includes plug contacts extending between the plug mating end and the plug mounting end. The plug mating end is configured to be plugged into a second slot of the communication connector to mate the plug contacts with the communication connector.

20 Claims, 16 Drawing Sheets

HIGH DENSITY COMMUNICATION SYSTEM

BACKGROUND OF THE INVENTION

The subject matter herein relates generally to communication systems.

Some communication systems utilize communication connectors to interconnect various components of the system for data communication. For example, the communication connector may be surrounded by a cage to provide electrical shielding around the communication connector. Some known communication systems use pluggable modules, such as I/O modules, that are received in the cage and electrically connected to the communication connector. The pluggable modules typically include a circuit board configured to be plugged into a card slot of the communication connector. However, data throughput may be limited through the pluggable module and the communication connector. To increase data throughput, some known pluggable modules and communication connectors include double rows of contacts. However, the close proximity of the two rows of contacts leads to problems with signal integrity.

A need remains for a high density communication system.

BRIEF DESCRIPTION OF THE INVENTION

In one embodiment, a pluggable module is provided. The pluggable module includes a pluggable body extending between a cable end and a mating end rearward of the cable end. The pluggable body has a module cavity. The pluggable module includes a module circuit board received in the module cavity. The module circuit board has a mating edge at a mating end configured to be plugged into a first slot of a communication connector. The pluggable module includes a plug connector extending between a plug mating end and a plug mounting end. The plug mounting end is mounted to the module circuit board. The plug connector plug contacts extend between the plug mating end and the plug mounting end. The plug mating end is configured to be plugged into a second slot of the communication connector to mate the plug contacts with the communication connector.

In another embodiment, a pluggable module is provided. The pluggable module includes a pluggable body extending between a cable end and a mating end rearward of the cable end. The pluggable body has a module cavity. The pluggable module includes a module circuit board received in the module cavity. The module circuit board has a mating edge at a mating end configured to be plugged into a first slot of a communication connector. The pluggable module includes a plug connector extending between a plug mating end and a plug mounting end, the plug mating end configured to be plugged into a second slot of the communication connector to mate the plug contacts with the communication connector. The plug mounting end is mounted to the module circuit board. The plug connector includes an inner contact assembly and an outer contact assembly with a ground plate between the inner contact assembly and the outer contact assembly. The inner contact assembly includes a dielectric inner frame holding inner signal plug contacts and inner ground plug contact. The outer contact assembly includes a dielectric outer frame holding outer signal plug contacts and outer ground plug contacts. The plug connector includes inner ground connecting tabs electrically connecting the inner ground plug contacts to the ground plate at an inner connecting location remote from the plug mating end and remote from the plug mounting end. The plug connector includes outer ground connecting tabs electrically connecting the outer ground plug contacts to the ground plate at an outer connecting location remote from the plug mating end and remote from the plug mounting end.

In a further embodiment, a pluggable module is provided. The pluggable module includes a pluggable body extending between a cable end and a mating end rearward of the cable end. The pluggable body has a module cavity. The pluggable module includes a module circuit board received in the module cavity. The module circuit board has a mating edge at a mating end configured to be plugged into a first slot of a communication connector. The pluggable module includes a plug connector extending between a plug mating end and a plug mounting end. The plug mating end is configured to be plugged into a second slot of the communication connector to mate the plug contacts with the communication connector. The plug mounting end is mounted to the module circuit board. The plug connector includes an inner contact assembly and an outer contact assembly with a ground plate between the inner contact assembly and the outer contact assembly. The inner contact assembly and the outer contact assembly include dielectric frames holding signal plug contacts and ground plug contacts. The signal plug contacts have signal mating ends at the plug mating end, signal terminating ends at the plug mounting end and signal transition portions between the signal mating ends and the signal terminating ends. The ground plug contacts have ground mating ends at the plug mating end and ground terminating ends at the plug mounting end, the ground plug contacts being discontinuous between the ground mating ends and the ground mounting ends. The ground mating ends and the ground terminating ends are coupled to the ground plate. The ground mating ends are electrically connected to the ground terminating ends through the ground plate.

DETAILED DESCRIPTION OF THE INVENTION

Figure 1:
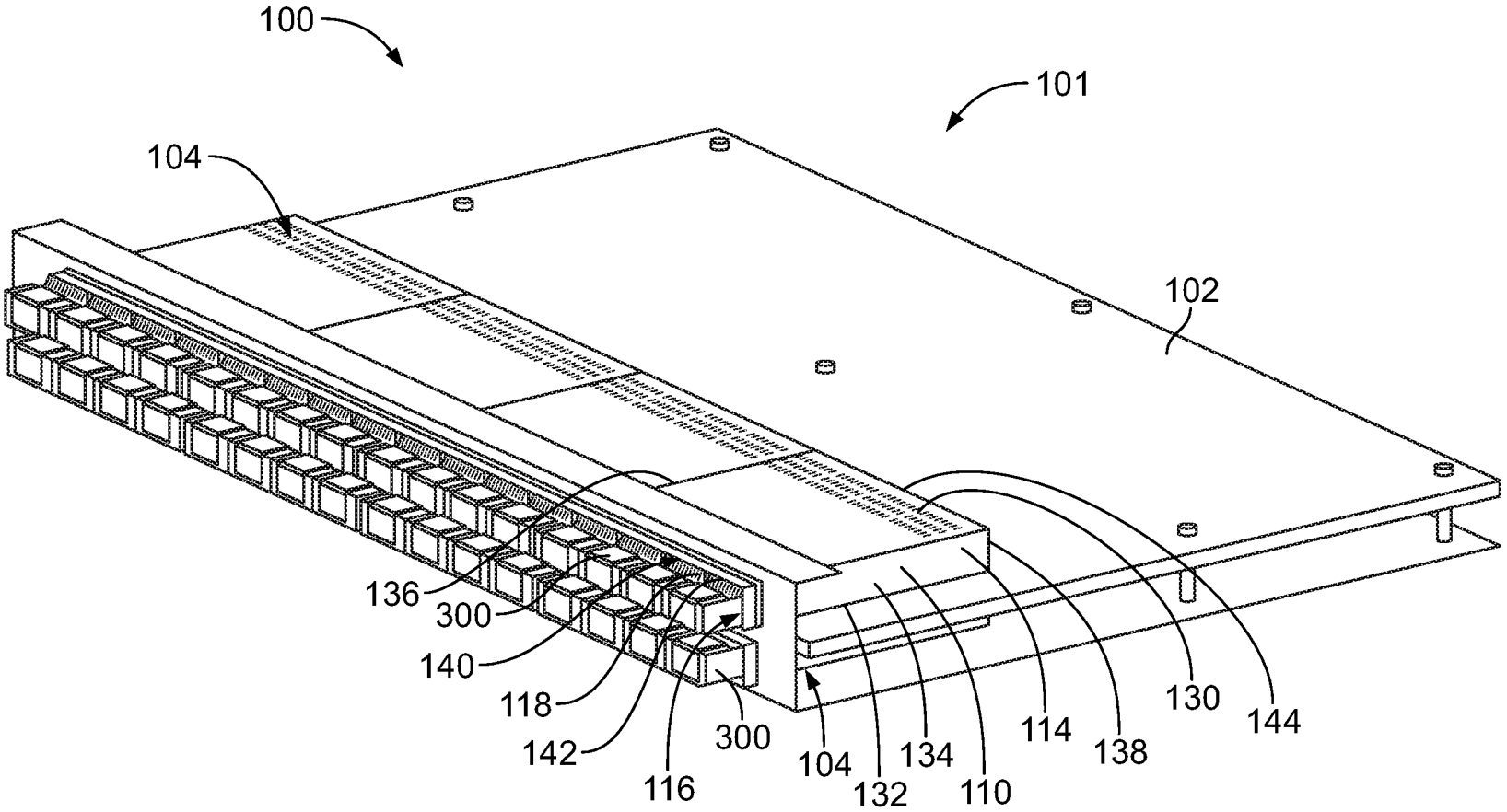
FIG. 1 is a front perspective view of a communication system formed in accordance with an exemplary embodiment.

FIG. 1 is a front perspective view of a communication system 100 formed in accordance with an exemplary embodiment. The communication system 100 includes one or more circuit board assemblies 101, which may be held in a rack, such as a server rack. Each circuit board assembly 101 includes a circuit board 102 and one or more receptacle connector assemblies 104 mounted to the circuit board 102. The receptacle connector assembly 104 is configured to receive one or more pluggable modules 300, such as I/O transceiver modules. The pluggable modules 300 are electrically connected to the circuit board 102 through the receptacle connector assembly 104. The communication system 100 may include panels having panel openings that receive corresponding receptacle connector assemblies 104 and/or pluggable modules 300.

In an exemplary embodiment, the receptacle connector assembly 104 includes a receptacle cage 110 and one or more communication connectors 200 (shown in FIGS. 2 and 3) adjacent the receptacle cage 110. In the illustrated embodiment, the communication connectors 200 are received in the receptacle cage 110. In other various embodiments, the communication connectors 200 may be located rearward of the receptacle cage 110. In various embodiments, the receptacle cage 110 is enclosed and provides electrical shielding for the communication connectors 200. When the pluggable modules 300 are loaded into the receptacle cage 110, the pluggable modules 300 are at least partially surrounded by the receptacle cage 110.

The receptacle cage 110 includes a plurality of walls 114 that define one or more module channels 116 for receipt of corresponding pluggable modules 300. Separator walls 118 may be arranged between the module channels 116. The walls 114 may be walls defined by solid sheets. The walls 114 may be perforated walls to allow airflow therethrough. The walls 114 may have cutouts, such as for a heatsink or heat spreader to pass therethrough. In an exemplary embodiment, the receptacle cage 110 is a shielded, stamped and formed cage member with the walls 114 being shielding walls.

In an exemplary embodiment, the receptacle cages 110 of the receptacle connector assemblies 104 may be stacked adjacent to each other along the upper surface of the circuit board 102 and/or along the lower surface of the circuit board 102. Various sized and shaped receptacle cages 110 may be provided to receive the various sized pluggable modules 300. Optionally, multiple communication connectors 200 may be arranged within the receptacle cage 110. For example, each module channel 116 may have an associated communication connector 200.

In an exemplary embodiment, the walls 114 of the receptacle cage 110 include an outer wall 130, an inner wall 132, a first side wall 134, a second side wall 136 and a rear wall 138. The inner wall 132 may rest on the circuit board 102. For example, the inner wall 132 may be a bottom wall (for example, to engage the upper surface of the circuit board 102) or may be a top wall (for example, to engage the lower surface of the circuit board 102). The walls 114 define a cavity 140. For example, the cavity 140 may be defined by the top wall 130, the bottom wall 132, the side walls 134, 136 and the rear wall 138. The walls 114 extend between a front 142 and a rear 144 of the receptacle cage 110. The separator walls 118 separate or divide the cavity 140 into the various module channels 116. In an exemplary embodiment, the communication connectors 200 are received in the cavity 140 proximate to the rear wall 138. The communication connectors 200 are aligned with the corresponding module channels 116.

Figure 2:
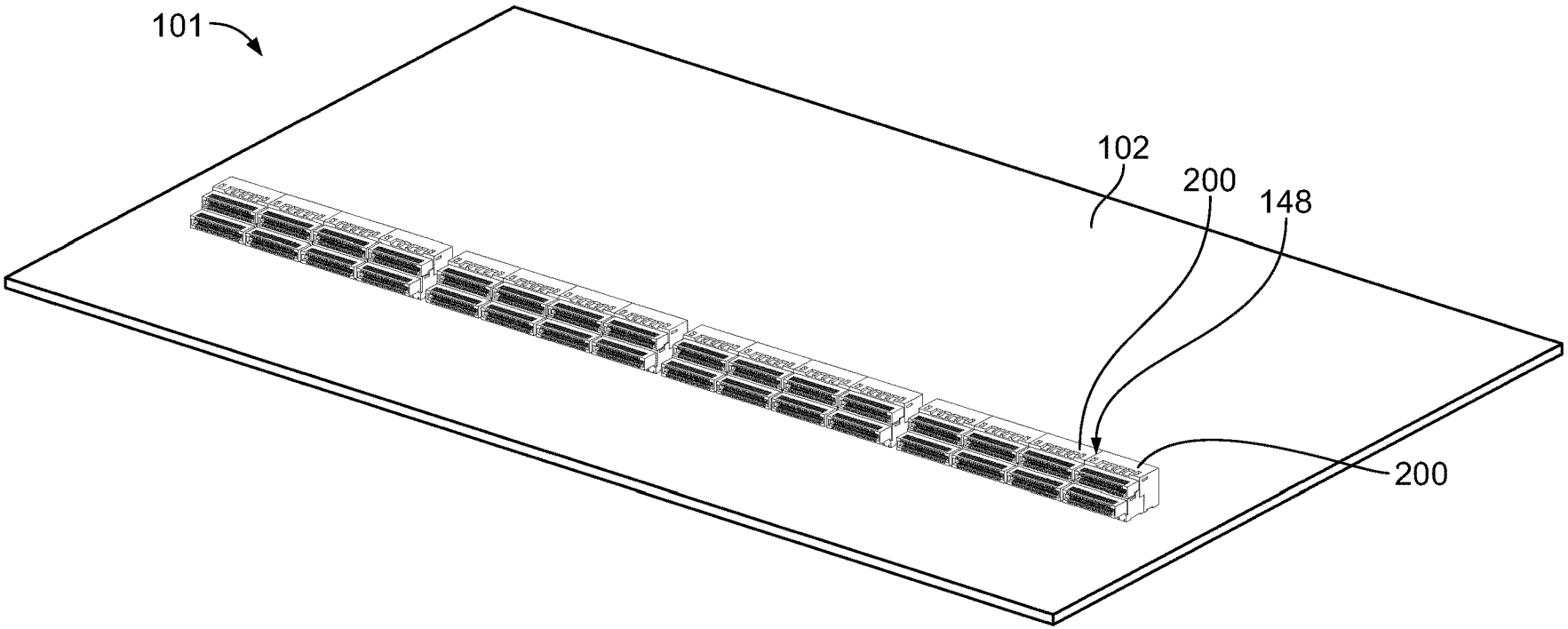
FIG. 2 is a perspective view of a portion of a circuit board assembly of the communication system in accordance with an exemplary embodiment.

FIG. 2 is a perspective view of a portion of the circuit board assembly 101, with the receptacle cage 110 (FIG. 1) removed to illustrate the communication connectors 200 mounted to the circuit board 102. Any number of the communication connectors 200 may be mounted to the circuit board 102. Optionally, the communication connectors 200 may be arranged in groups, such as groups of four communication connectors 200. Each group of communication connectors 200 is received in the corresponding receptacle cage 110.

Each communication connector 200 is coupled to the circuit board 102 at an appropriate mounting location. Optionally, gaps 148 may be provided between the communication connectors 200. The gaps 148 between the communication connectors 200 within a group may be the same (for example, at a common pitch). The gap 148 may accommodate the separator walls 118 (shown in FIG. 1). The gaps 148 between communication connectors 200 of different groups may be different, such as to accommodate the side walls of both receptacle cages 110. The communication connector 200 may be surface mounted to the circuit board 102 in various embodiments. The communication connector 200 may be press-fit to the circuit board 102 in various embodiments. The communication connector 200 may be through hole soldered to the circuit board 102 in various embodiments.

Figure 3:
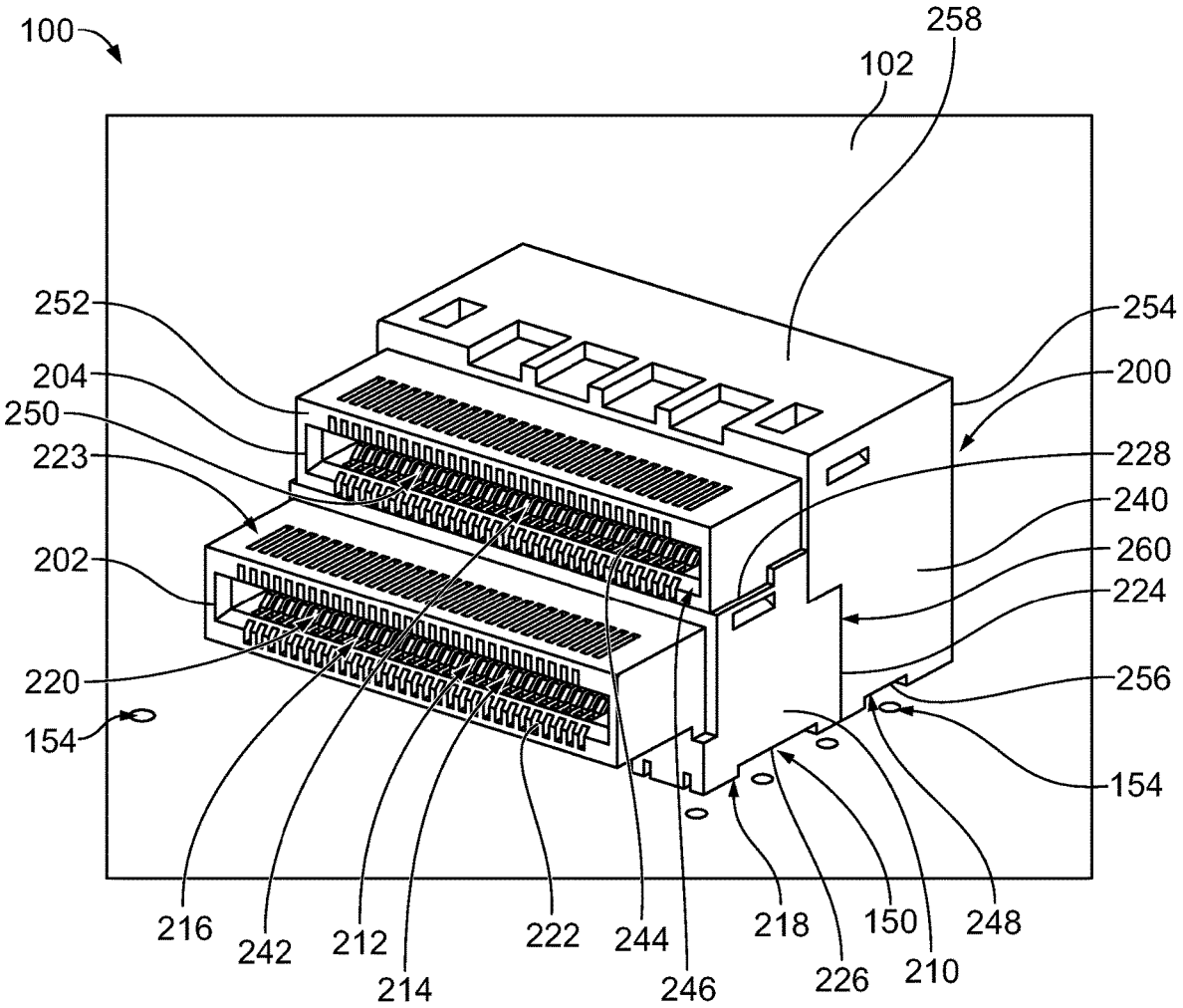
FIG. 3 is a perspective view of a portion of the communication system showing a communication connector of the circuit board assembly in accordance with an exemplary embodiment.

FIG. 3 is a perspective view of a portion of the communication system 100 showing one of the communication connectors 200 mounted to the circuit board 102 in accordance with an exemplary embodiment. The circuit board 102 includes a mounting area 150. The communication connector 200 is mounted to the mounting area 150 of the circuit board 102. The circuit board 102 includes vias 154 configured to receive mounting pins, such as press-fit pins, of the receptacle cage 110 (FIG. 1) to align and secure the receptacle cage 110 to the circuit board 102. The circuit board 102 includes conductors, such as signal conductors and ground conductors, configured to be electrically connected to contacts of the communication connector 200. In various embodiments, the conductors may be contact pads or other circuit traces of the circuit board 102. The contacts of the communication connector 200 may be soldered to the contact pads. In other various embodiments, the conductors may be plated vias and the contact of the communication connector 200 may be press-fit into the plated vias.

The communication connector 200 includes an inner receptacle connector 202 and an outer receptacle connector 204. The inner receptacle connector 202 is located between the outer receptacle connector 204 and the circuit board 102. The inner receptacle connector 202 defines a first mating interface and first signal paths between the circuit board 102 and the pluggable module 300. The outer receptacle connector 204 defines a second mating interface and second signal paths between the circuit board 102 and the pluggable module 300.

The inner receptacle connector 202 has an inner housing 210 holding an inner contact array 212 of inner contacts 214. The inner housing 210 is manufactured from a dielectric material, such as a plastic material. The inner receptacle connector 202 has an inner mating interface 216 and an inner mounting interface 218 configured to be mounted to the circuit board 102. The inner mounting interface 218 is perpendicular to the inner mating interface 216 in the illustrated embodiment. For example, the inner receptacle connector 202 is a right-angle connector. The inner receptacle connector 202 may be a straight pass-through connector in an alternative embodiment rather than a right-angle connector. The inner contacts 214 extend between the inner mating interface 216 and the inner mounting interface 218. The inner contacts 214 in the inner contact array 212 include a plurality of signal contacts and a plurality of ground contacts. The inner contacts 214 include spring beams defining separable interfaces at the inner mating interface 216. The inner contacts 214 may include solder tails or press-fit pins at the inner mounting interface 218 for termination to the circuit board 102.

The inner mating interface 216 includes a first slot 220, which may be a card slot configured to receive a card edge of a circuit card or a plug slot configured to receive a plug edge of a plug connector. The inner contacts 214 are arranged in the first slot 220 to interface with the pluggable module 300. The inner contacts 214 may be arranged along a top and a bottom of the first slot 220 for interfacing with upper and lower contacts of the plug that is plugged into the first slot 220. The inner contact array 212 is a lower contact array in the illustrated embodiment located below the outer receptacle connector 204.

The inner housing 210 has a front 222 and a rear 224. The inner mating interface 216 is provided at the front 222. The outer receptacle connector 204 extends along the rear 224 and is thus rearward of the inner receptacle connector 202. The inner housing 210 has an inner end 226 and an outer end 228. The inner mounting interface 218 is provided at the inner end 226. The inner end 226 is mounted to the circuit board 102. In the illustrated embodiment, the inner end 226 is a bottom of the inner housing 210. However, for communication connectors 200 mounted to the lower surface of the circuit board 102, the inner end 226 is a top of the inner housing 210. The outer receptacle connector 204 extends along the outer end 228.

The outer receptacle connector 204 has an outer housing 240 holding an outer contact array 242 of outer contacts 244. The outer housing 240 is manufactured from a dielectric material, such as a plastic material. The outer receptacle connector 204 has an outer mating interface 246 and an outer mounting interface 248 configured to be mounted to the circuit board 102. The outer mounting interface 248 is perpendicular to the outer mating interface 246 in the illustrated embodiment. For example, the outer receptacle connector 204 is a right-angle connector. The outer receptacle connector 204 may be a straight pass-through connector in an alternative embodiment rather than a right-angle connector. The outer contacts 244 extend between the outer mating interface 246 and the outer mounting interface 248. The outer contacts 244 in the outer contact array 242 include a plurality of signal contacts and a plurality of ground contacts. The outer contacts 244 include spring beams defining separable interfaces at the outer mating interface 246. The outer contacts 244 may include solder tails or press-fit pins at the outer mounting interface 248 for termination to the circuit board 102.

The outer mating interface 246 includes a second slot 250, which may be a card slot configured to receive a card edge of a circuit card or a plug slot configured to receive a plug edge of a plug connector. The outer contacts 244 are arranged in the second slot 250 to interface with the pluggable module 300. The outer contacts 244 may be arranged along a top and a bottom of the second slot 250 for interfacing with upper and lower contacts of the plug that is plugged into the second slot 250. The outer contact array 242 is an upper contact array in the illustrated embodiment located above the outer receptacle connector 204.

The outer housing 240 has a front 252 and a rear 254. The outer mating interface 246 is provided at the front 252. The front 252 of the outer receptacle connector 204 extends along the rear 224 of the inner receptacle connector 202 and is thus rearward of the inner receptacle connector 202. The outer housing 240 has an inner end 256 and an outer end 258. The inner end 256 is mounted to the circuit board 102. In the illustrated embodiment, the outer end 258 is a bottom of the outer housing 240. However, for communication connectors 200 mounted to the lower surface of the circuit board 102, the outer end 258 is a top of the outer housing 240. The inner end 256 of the outer housing 240 includes a pocket 260 that receives the inner housing 210. The outer housing 240 thus surrounds a portion of the inner housing 210.

In an exemplary embodiment, the outer mating interface 246 is recessed relative to the inner mating interface 216. For example, the front 252 of the outer housing 240 is located rearward of the front 222 of the inner housing 210. As such, the first slot 220 is located forward of the second slot 250. The inner housing 210 includes an extension 223 extending to the front 222 of the inner housing 210. The extension 223 extends forward of the outer housing 240.

In the illustrated embodiment, the inner housing 210 is separate and discrete from the outer housing 240. The outer housing 240 may be coupled to the inner housing 210. For example, the inner housing 210 may support the outer housing 240. In alternative embodiments, the inner housing 210 and the outer housing 240 may be integral as a unitary housing holding both the inner contact array 212 and the outer contact array 242. For example, the inner housing 210 and the outer housing 240 may be co-molded during a single molding process rather than being separately molded pieces.

Figure 4:
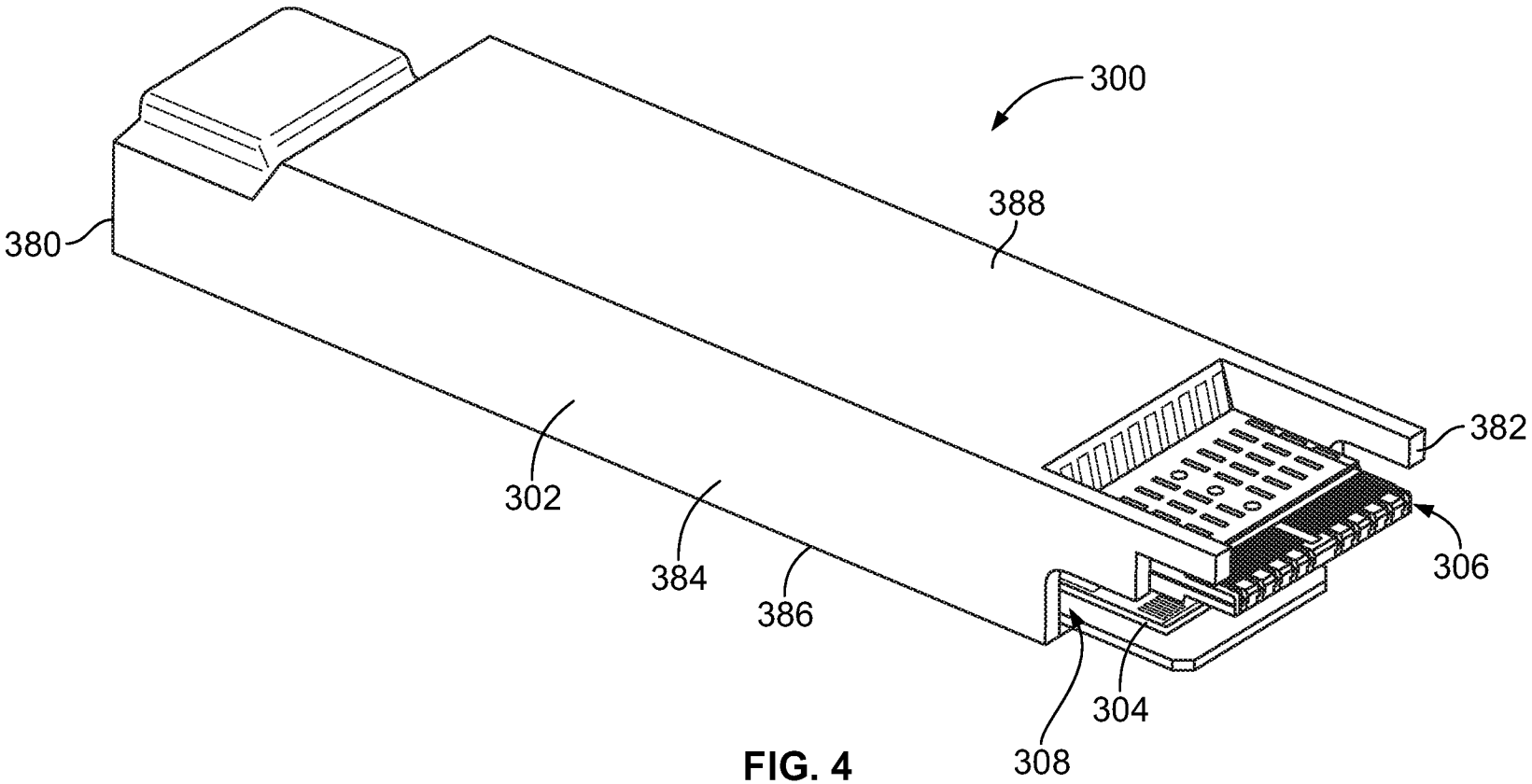
FIG. 4 is a perspective view of a pluggable module of the communication system in accordance with an exemplary embodiment.

FIG. 4 is a perspective view of the pluggable module 300 in accordance with an exemplary embodiment. The pluggable module 300 includes a pluggable body 302 that holds a module circuit board 304 and a plug connector 306 in a module cavity 308 of the pluggable body 302. The plug connector 306 extends from the module circuit board 304. The pluggable body 302 is configured to be plugged into the module channel 116 of the receptacle cage 110 (FIG. 1) for mating with the communication connector 200 (FIG. 3). The module circuit board 304 is mated with the inner receptacle connector 202 (FIG. 3) and the plug connector 306 is mated with the outer receptacle connector 204 (FIG. 3).

The pluggable body 302 extends between a cable end 380 at a front of the pluggable module 300 and a mating end 382 at a rear of the pluggable module 300. The pluggable body 302 includes sides 384 extending between an inner end 386 and an outer end 388. The inner end 386 may be a bottom and the outer end 388 may be a top. However, the pluggable module 300 may be mated in an inverted orientation, such as to a receptacle cage 110 on a lower surface of the circuit board 102. The sides 384 and the ends 386, 388 define the module cavity 308. The pluggable body 302 may include openings to allow airflow through the pluggable module 300 for cooling the components of the pluggable module 300. The module circuit board 304 and the plug connector 306 are positioned in the module cavity 308 for mating with the communication connector 200. For example, the pluggable body 302 may be open at the mating end 382 to expose mating ends of the module circuit board 304 and the plug connector 306.

Figure 5:
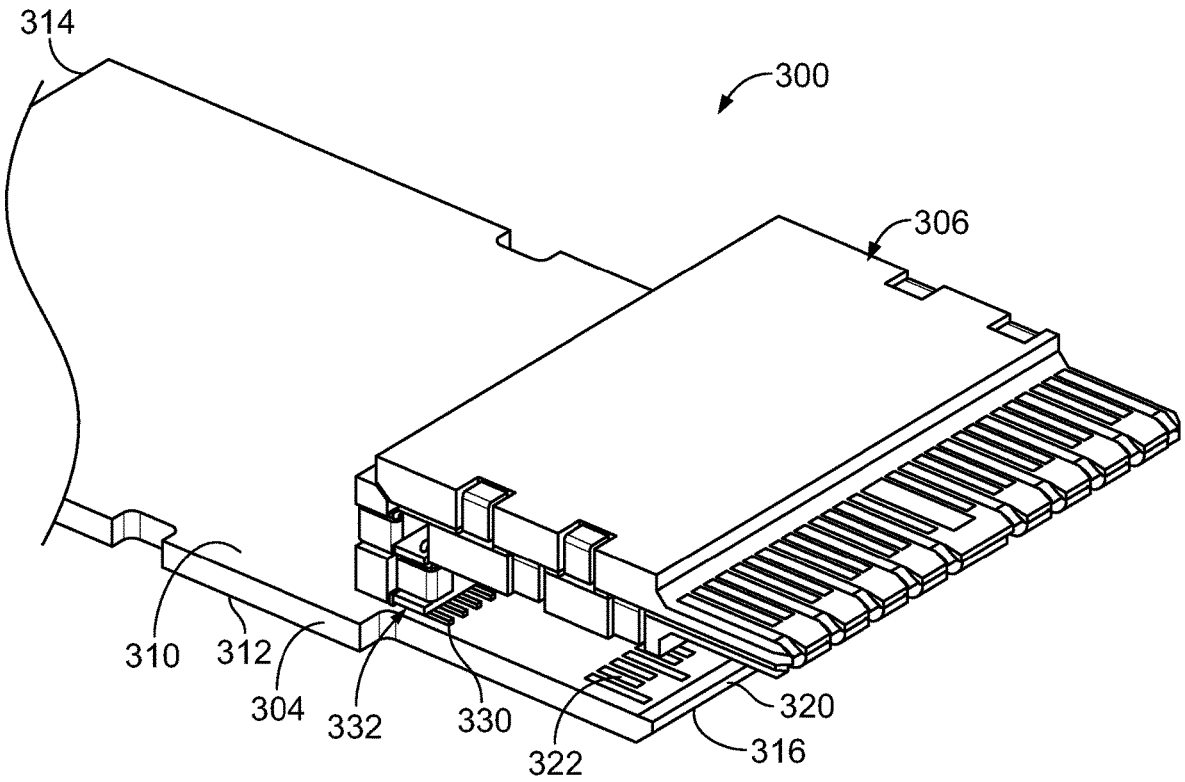
FIG. 5 is a rear perspective view of a portion of the pluggable module in accordance with an exemplary embodiment.
Figure 6:
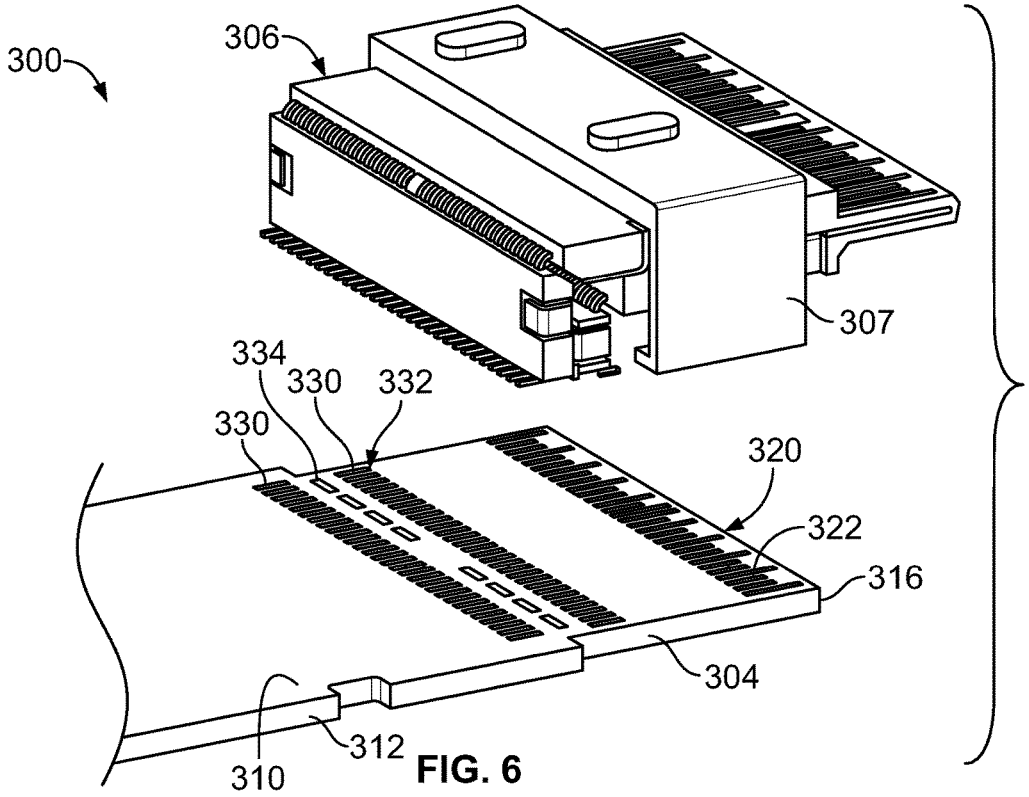
FIG. 6 is an exploded, front perspective view of a portion of the pluggable module in accordance with an exemplary embodiment.

FIG. 5 is a rear perspective view of a portion of the pluggable module 300 in accordance with an exemplary embodiment. FIG. 6 is an exploded, front perspective view of a portion of the pluggable module 300 in accordance with an exemplary embodiment. The pluggable body 302 (shown in FIG. 4) is removed to illustrate the module circuit board 304 and the plug connector 306. The plug connector 306 extends from the module circuit board 304 to form a dual mating interface for the pluggable module 300 to increase the density of the signal paths through the pluggable module 300 and thus increase the data throughput for the pluggable module 300. FIG. 6 illustrates a mounting support 307 used for mounting the plug connector 306 to the module circuit board 304. The mounting support 307 is removable after soldering the plug connector 306 to the module circuit board 304.

The module circuit board 304 includes a first surface 310 and a second surface 312 extending between a cable end 314 and a mating end 316 rearward of the cable end 314. The module circuit board 304 has a mating edge 320 at the mating end 316 configured to be plugged into the first slot 220 of the communication connector 200 (FIG. 3). The module circuit board 304 has mating pads 322 at the mating edge 320. The mating pads 322 may include signal mating pads and/or ground mating pads and/or power mating pads. In an exemplary embodiment, the mating pads 322 are provided on the first surface 310 and the second surface 312 to increase density of the module circuit board 304. The mating pads 322 are configured to be mated with inner contacts 214 of the communication connector 200 when the mating edge 320 is plugged into the first slot 220 of the communication connector 200.

The module circuit board 304 includes connector pads 330 at a mounting location 332 on the first surface 310. The connector pads 330 may include signal connector pads and/or ground connector pads and/or power connector pads. The connector pads 330 are located remote from the mating edge 320, such as forward of the mating edge 320. In the illustrated embodiment, the connector pads 330 are arranged in multiple rows, such as a forward row and a rearward row. The module circuit board 304 may include a row of ground pads 334 between the forward row and the rearward row. The plug connector 306 is terminated to the module circuit board 304 at the mounting location 332. For example, the plug connector 306 may be soldered to the connector pads 330.

Figure 7:
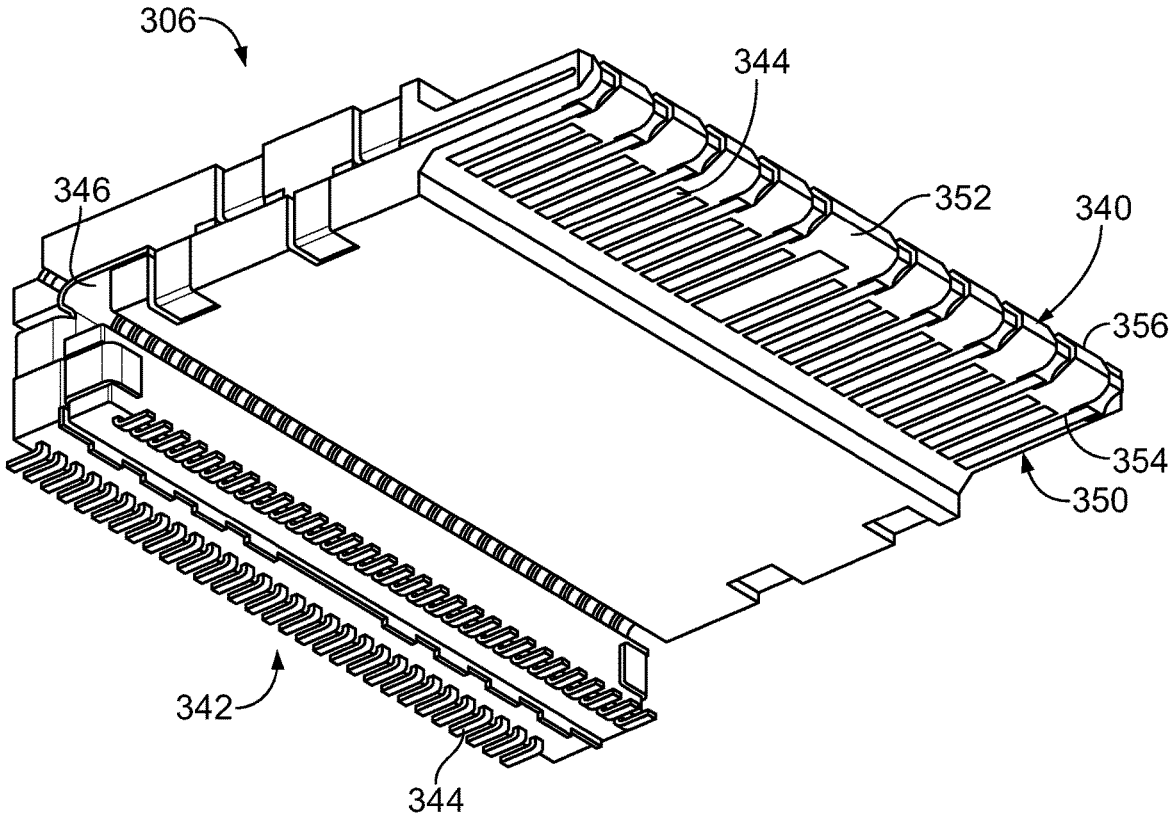
FIG. 7 is a bottom perspective view of the plug connector in accordance with an exemplary embodiment.
Figure 8:
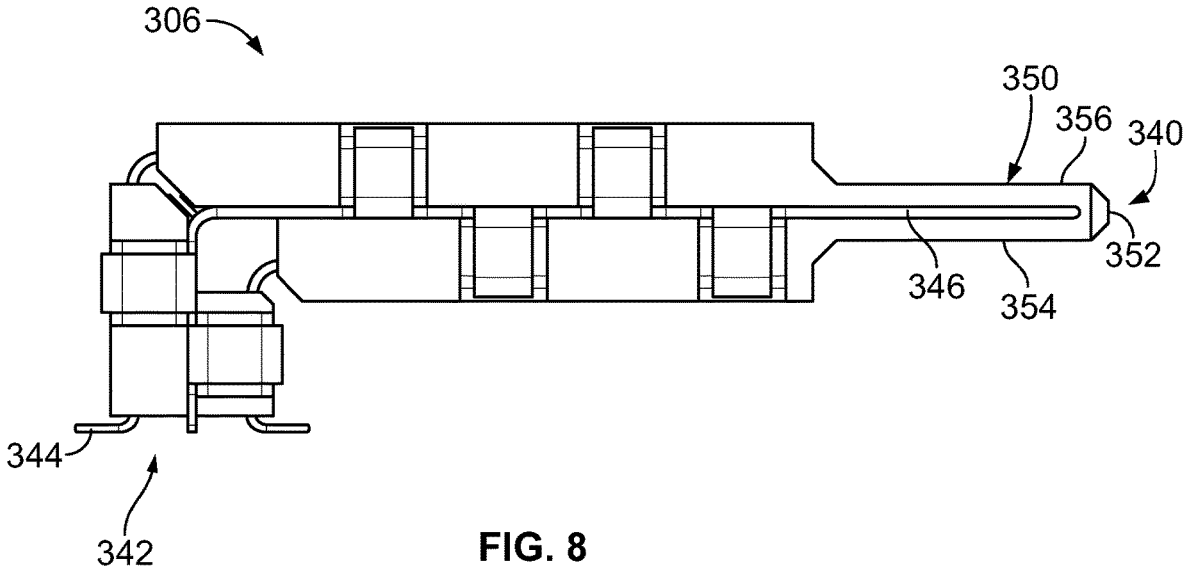
FIG. 8 is a side view of the plug connector in accordance with an exemplary embodiment.

FIG. 7 is a bottom perspective view of the plug connector 306 in accordance with an exemplary embodiment. FIG. 8 is a side view of the plug connector 306 in accordance with an exemplary embodiment. The plug connector 306 extends between a plug mating end 340 and a plug mounting end 342. The plug mounting end 342 is configured to be mounted to the module circuit board 304 at the mounting location 332 (shown in FIG. 6). The plug connector 306 includes plug contacts 344 extending between the plug mating end 340 and the plug mounting end 342. The plug mating end 340 is configured to be plugged into the second slot 250 (FIG. 3) of the communication connector 200 (FIG. 3) to mate the plug contacts 344 with the outer contacts 244 (FIG. 3) of the communication connector 200. In an exemplary embodiment, the plug connector 306 includes a ground plate 346 providing a reference ground for the signals and electrical shielding between the upper and lower plug contacts 344. The ground plate 346 may be terminated to the ground pads 334 (FIG. 6).

In an exemplary embodiment, the plug connector 306 includes a platform 350 extending to a platform edge 352 at the plug mating end 340. The platform 350 supports the plug contacts 344. In an exemplary embodiment, the plug contacts 344 are provided on an inner surface 354 and an outer surface 356 of the platform 350 (for example, the top surface and the bottom surface of the platform 350). The platform 350 is configured to be oriented parallel to and spaced apart from the module circuit board 304. The inner surface 354 faces the module circuit board 304. The plug contacts 344 extend along the platform 350 to the platform edge 352. The platform edge 352 is configured to be plugged into the second slot 250 of the communication connector 200.

Figure 9:
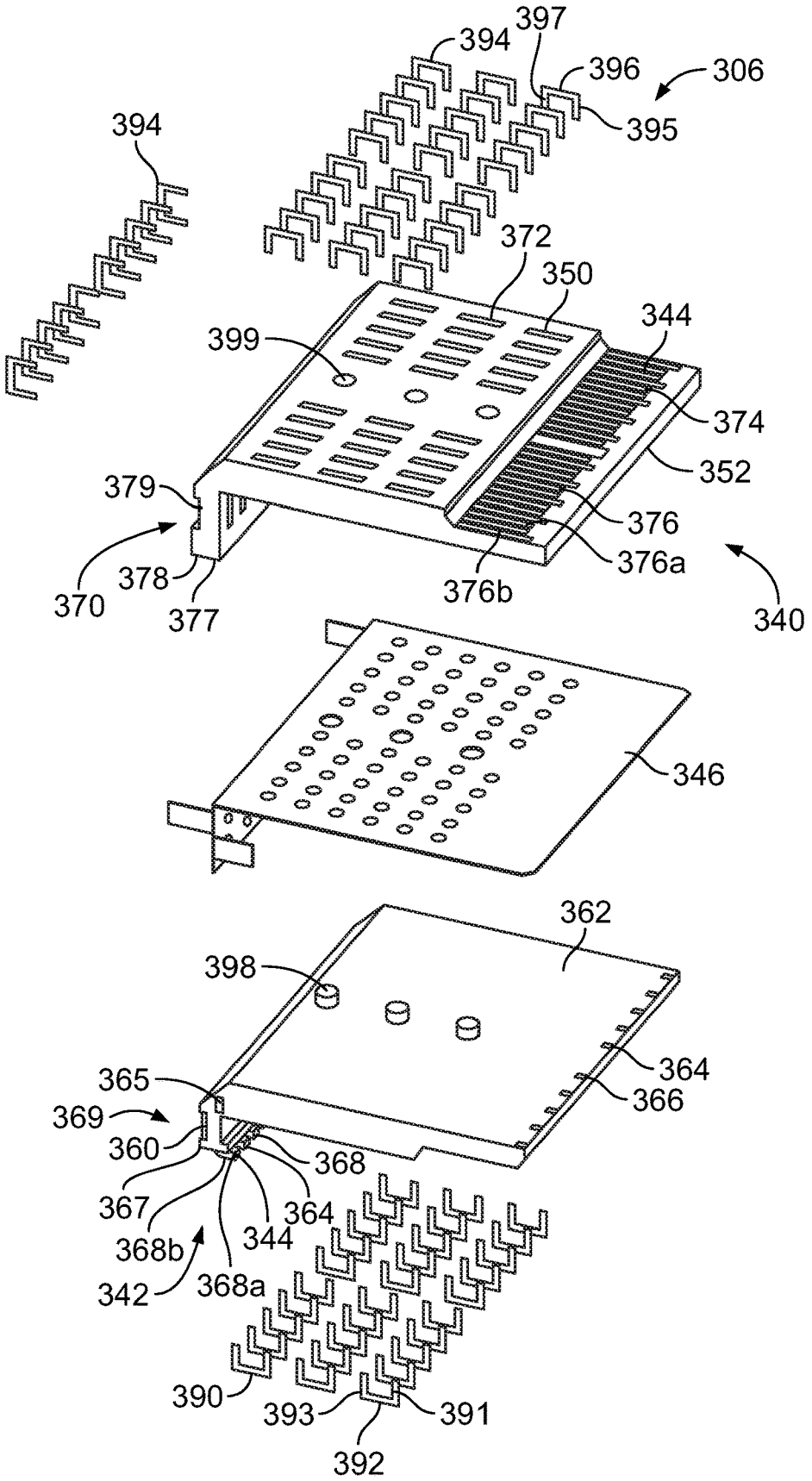
FIG. 9 is an exploded, rear perspective view of the plug connector in accordance with an exemplary embodiment.
Figure 10:
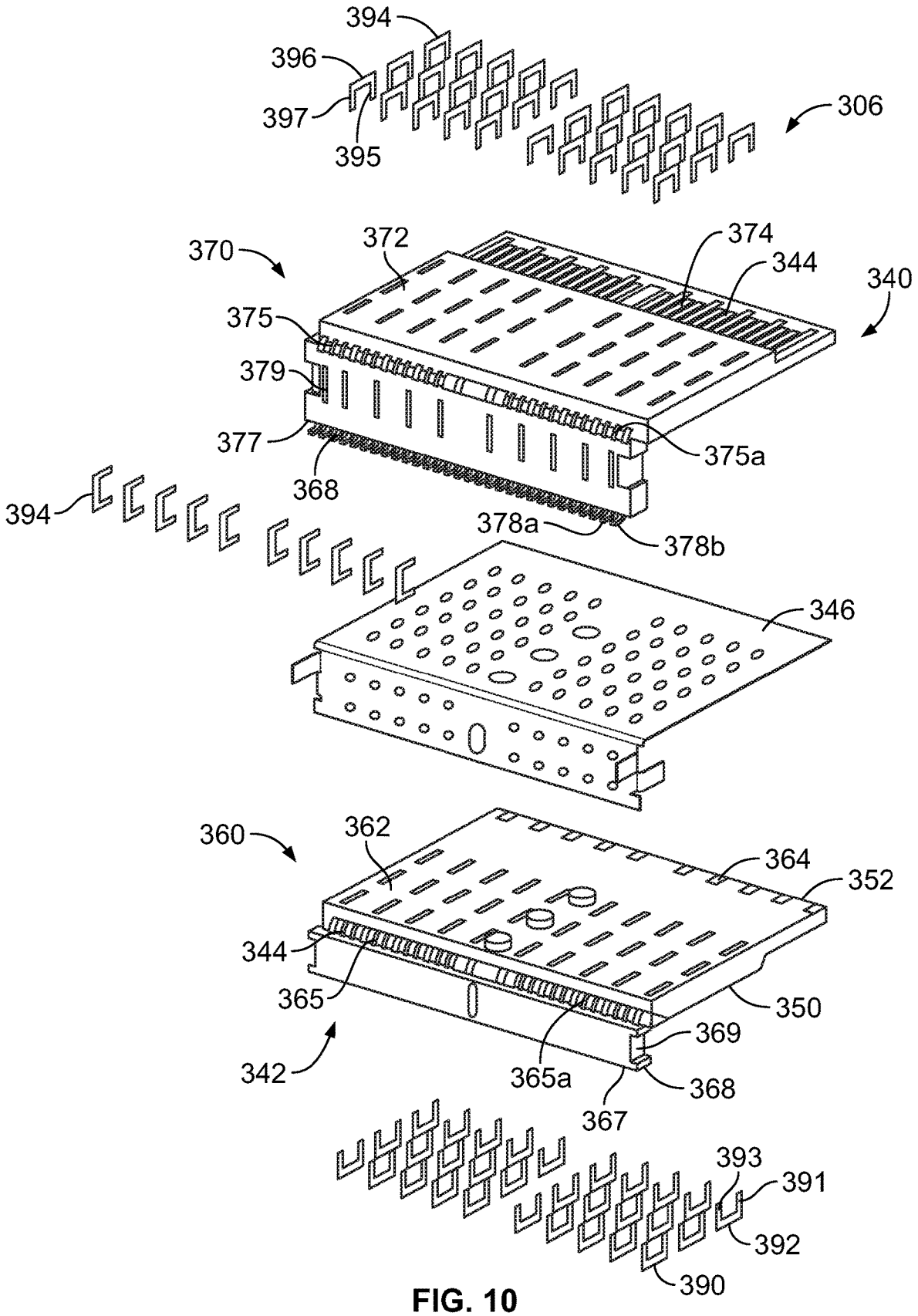
FIG. 10 is an exploded, front perspective view of the plug connector in accordance with an exemplary embodiment.

FIG. 9 is an exploded, rear perspective view of the plug connector 306 in accordance with an exemplary embodiment. FIG. 10 is an exploded, front perspective view of the plug connector 306 in accordance with an exemplary embodiment. In an exemplary embodiment, the plug connector 306 includes an inner contact assembly 360 and an outer contact assembly 370. In the illustrated embodiment, the inner and outer contact assemblies 360, 370 are separate and discrete components. For example, the inner and outer contact assemblies 360, 370 are separately manufactured and then coupled together to form the plug connector 306. In an exemplary embodiment, the ground plate 346 is located between the inner contact assembly 360 and the outer contact assembly 370. The plug connector 306 may be oriented in an upright orientation such that the inner contact assembly 360 is a lower contact assembly and the outer contact assembly 370 is an upper contact assembly. However, the plug connector 306 may be oriented in an upside-down orientation such that the inner contact assembly 360 is an upper contact assembly and the outer contact assembly 370 is a lower contact assembly.

The inner contact assembly 360 includes a dielectric inner frame 362 holding inner plug contacts 364. The inner plug contacts 364 define a subset or group of the plug contacts 344. In an exemplary embodiment, the inner plug contacts 364 are a leadframe. For example, the inner plug contacts 364 may be stamped and formed contacts. In an exemplary embodiment, the inner frame 362 is overmolded over the inner plug contacts 364. Alternatively, the inner plug contacts 364 may be loaded into a pre-molded inner frame 362. The inner plug contacts 364 may include signal contacts 364 and/or ground contacts 364 and/or power contacts. In various embodiments, the signal contacts 364 may be arranged in pairs with ground contacts 364 arranged between the pairs of signal contacts 364. Each inner plug contact 364 includes a transition portion 365 extending between a mating end 366 and a terminating end 368. The mating end 366 is provided near the rear edge of the inner frame 362 (for example, the platform edge 352). The terminating end 368 is provided at an inner edge 367 of a platform support 369 for termination to the module circuit board 304.

In an exemplary embodiment, the inner signal plug contacts 364 include mating pads 366*a* at the mating ends 366 defining separable interfaces and include solder tails 368*a* or press-fit pins (not shown) at the terminating ends 368 for termination to the circuit board 102. The transition portions 365 include bends 365*a* between the mating ends 366 and the terminating ends 368. For example, the bends 365*a* may be 90° bends. In the illustrated embodiment, the mating ends 366 are oriented perpendicular to the terminating ends 368. For example, the mating ends 366 may be oriented horizontally and the terminating ends 368 may be oriented vertically. The transition portion 365 includes first segments between the bends 365*a* and the mating ends 366 and second segments between the bends 365*a* and the terminating ends 368. The first segments may be longer than the second segments in various embodiments.

In an exemplary embodiment, the inner ground plug contacts 364 include mating pads 366*b* at the mating ends 366 defining separable interfaces and include solder tails 368*b* or press-fit pins (not shown) at the terminating ends 368 for termination to the circuit board 102. The transition portions 365 include bends 365*b* between the mating ends 366 and the terminating ends 368. For example, the bends 365*b* may be 90° bends. In the illustrated embodiment, the mating ends 366 are oriented perpendicular to the terminating ends 368. For example, the mating ends 366 may be oriented horizontally and the terminating ends 368 may be oriented vertically. The transition portion 365 includes first segments between the bends 365*b* and the mating ends 366 and second segments between the bends 365*b* and the terminating ends 368. The first segments may be longer than the second segments in various embodiments.

In an exemplary embodiment, the inner power plug contacts include mating pads at the mating ends defining separable interfaces and include solder tails or press-fit pins (not shown) at the terminating ends for termination to the circuit board 102. The transition portions include bends between the mating ends and the terminating ends.

In an exemplary embodiment, the inner contact assembly 360 includes inner ground connecting tabs 390 electrically connecting the inner ground plug contacts 364 to the ground plate 346. The inner ground connecting tabs 390 are provided at inner connecting locations remote from the plug mating end 340 and remote from the plug mounting end 342. The inner ground connecting tabs 390 are separate and discrete from the ground plate 346 and physically coupled thereto to make an electrical connection between the ground plate 346 and the inner ground plug contacts 364. In an exemplary embodiment, the inner contact assembly 360 includes a plurality of the inner ground connecting tabs 390 engaging each inner ground plug contact 364. The inner ground connecting tabs 390 shorten effective lengths of the inner ground plug contacts 364. The inner ground connecting tabs 390 may be plugged into the inner frame 362 and may be held in the inner frame 362 by an interference fit. The inner ground connecting tabs 390 may be plugged into the platform 350 and/or the platform support 369.

In an exemplary embodiment, the inner ground connecting tab 390 is U-shaped. For example, the inner ground connecting tab 390 may be shaped like a staple. The inner ground connecting tab 390 includes a main body 392, a first arm 391 extending from the main body 392 and a second arm 393 extending from the main body 392. The first arm 391 has a first mating interface and the second arm 393 has a second mating interface. The first and second mating interfaces of the inner ground connecting tab 390 are separately coupled to the ground plate 346 at different inner connecting locations. As such, each inner ground connecting tab 390 has multiple points of contact with the ground plate 346 and/or the inner ground plug contact 364. The inner ground connecting tab 390 may include greater or fewer arms in alternative embodiments. The inner ground connecting tab 390 may be soldered to the ground plate 346 and/or the inner ground plug contact 364 in various embodiments. In other various embodiments, the inner ground connecting tab 390 may be press fit into openings or slots formed in the ground plate 346 and/or the inner ground plug contact 364.

The outer contact assembly 370 includes a dielectric outer frame 372 holding outer plug contacts 374. The outer plug contacts 374 define a subset or group of the plug contacts 344. In an exemplary embodiment, the outer plug contacts 374 are a leadframe. For example, the outer plug contacts 374 may be stamped and formed contacts. In an exemplary embodiment, the outer frame 372 is overmolded over the outer plug contacts 374. Alternatively, the outer plug contacts 374 may be loaded into a pre-molded outer frame 372. The outer plug contacts 374 may include signal contacts 374 and/or ground contacts 374 and/or power contacts 374*c*. In various embodiments, the signal contacts 374 may be arranged in pairs with ground contacts 374 arranged between the pairs of signal contacts 374. Each outer plug contact 374 includes a transition portion 375 extending between a mating end 376 and a terminating end 378. The mating end 376 is provided near the rear edge of the outer frame 372 (for example, the platform edge 352). The terminating end 378 is provided at an outer edge 377 of a platform support 379 for termination to the module circuit board 304.

In an exemplary embodiment, the outer signal plug contacts 374 include mating pads 376*a* at the mating ends 376 defining separable interfaces and include solder tails 378*a* or press-fit pins (not shown) at the terminating ends 378 for termination to the circuit board 102. The transition portions 375 include bends between the mating ends 376 and the terminating ends 378. For example, the bends may be 90° bends. In the illustrated embodiment, the mating ends 376 are oriented perpendicular to the terminating ends 378. For example, the mating ends 376 may be oriented horizontally and the terminating ends 378 may be oriented vertically. The transition portion 375 includes first segments between the bends and the mating ends 376 and second segments between the bends and the terminating ends 378. The first segments may be longer than the second segments in various embodiments.

In an exemplary embodiment, the outer ground plug contacts 374 include mating pads 376*b* at the mating ends 376 defining separable interfaces and include solder tails 378*b* or press-fit pins (not shown) at the terminating ends 378 for termination to the circuit board 102. The transition portions 375 include bends between the mating ends 376 and the terminating ends 378. For example, the bends may be 90° bends. In the illustrated embodiment, the mating ends 376 are oriented perpendicular to the terminating ends 378. For example, the mating ends 376 may be oriented horizontally and the terminating ends 378 may be oriented vertically. The transition portion 375 includes first segments between the bends and the mating ends 376 and second segments between the bends and the terminating ends 378. The first segments may be longer than the second segments in various embodiments.

In an exemplary embodiment, the outer power plug contacts include mating pads at the mating ends defining separable interfaces and include solder tails or press-fit pins (not shown) at the terminating ends for termination to the circuit board 102. The transition portions include bends between the mating ends and the terminating ends.

In an exemplary embodiment, the outer contact assembly 370 includes outer ground connecting tabs 394 electrically connecting the outer ground plug contacts 374 to the ground plate 346. The outer ground connecting tabs 394 are provided at outer connecting locations remote from the plug mating end 340 and remote from the plug mounting end 342. The outer ground connecting tabs 394 are separate and discrete from the ground plate 346 and physically coupled thereto to make an electrical connection between the ground plate 346 and the outer ground plug contacts 374. In an exemplary embodiment, the outer contact assembly 370 includes a plurality of the outer ground connecting tabs 394 engaging each outer ground plug contact 374. The outer ground connecting tabs 394 shorten effective lengths of the outer ground plug contacts 374. The outer ground connecting tabs 394 may be plugged into the outer frame 372 and may be held in the outer frame 372 by an interference fit. The outer ground connecting tabs 394 may be plugged into the platform 350 and/or the platform support 379.

In an exemplary embodiment, the outer ground connecting tab 394 is U-shaped. For example, the outer ground connecting tab 394 may be shaped like a staple. The outer ground connecting tab 394 includes a main body 396, a first arm 395 extending from the main body 396 and a second arm 397 extending from the main body 396. The first arm 395 has a first mating interface and the second arm 397 has a second mating interface. The first and second mating interfaces of the outer ground connecting tab 394 are separately coupled to the ground plate 346 at different outer connecting locations. As such, each outer ground connecting tab 394 has multiple points of contact with the ground plate 346 and/or the outer ground plug contact 374. The outer ground connecting tab 394 may include greater or fewer arms in alternative embodiments. The outer ground connecting tab 394 may be soldered to the ground plate 346 and/or the outer ground plug contact 374 in various embodiments. In other various embodiments, the outer ground connecting tab 394 may be press fit into openings or slots formed in the ground plate 346 and/or the outer ground plug contact 374.

In an exemplary embodiment, the inner frame 362 includes alignment features 398 and the outer frame 372 includes alignment features 399 that interface with the alignment features 398. For example, the alignment features 398 may be posts and the alignment features 399 may be openings. In the illustrated embodiment, the posts are cylindrical and the openings are hexagonal shaped. The posts may be held in the openings by an interference fit. The posts may pass through openings in the ground plate 346 to orient the ground plate 346 relative to the inner and outer frames 362, 372.

Figure 11:
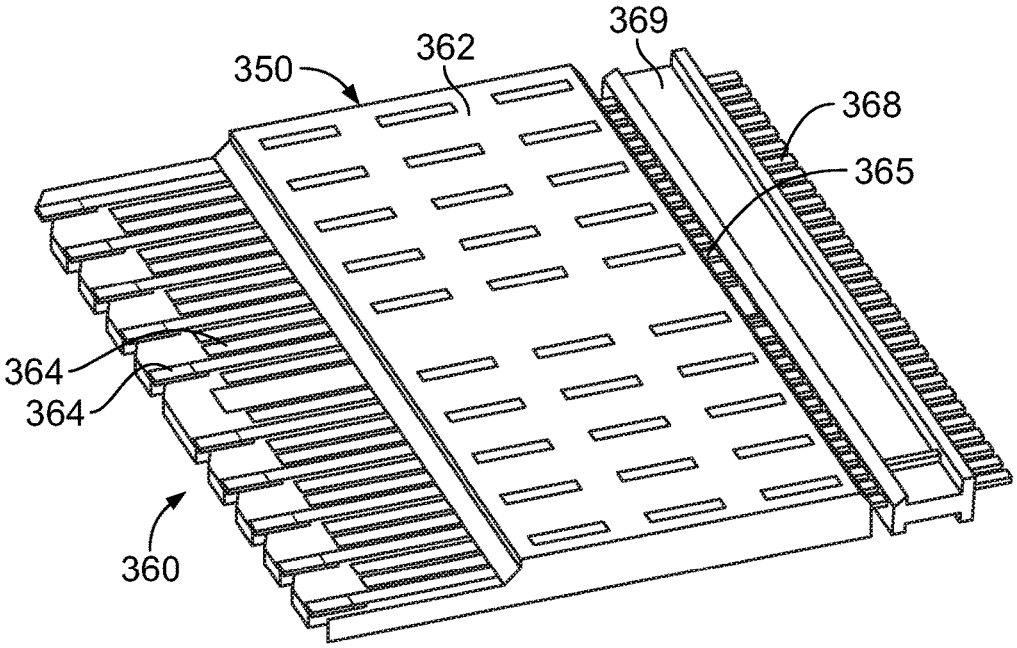
FIG. 11 is a bottom perspective view of the inner contact assembly in a flat state in accordance with an exemplary embodiment.

FIG. 11 is a bottom perspective view of the inner contact assembly 360 in a flat state. The inner frame 362 includes separate sections defining a portion of the platform 350 and the platform support 369. For example, the inner frame 362 may be overmolded over the leadframe in two separate sections. The transition portions 365 of the inner plug contacts 364 extend between the sections and may be bent during a forming process (for example, bent 90°). The mating ends 366 of the inner contacts are exposed along the bottom of the platform 350. The terminating ends 368 extend from the inner frame 362. The terminating ends 368 may be bent during a forming process (for example, bent 90°) to form the solder tails.

Figure 12:
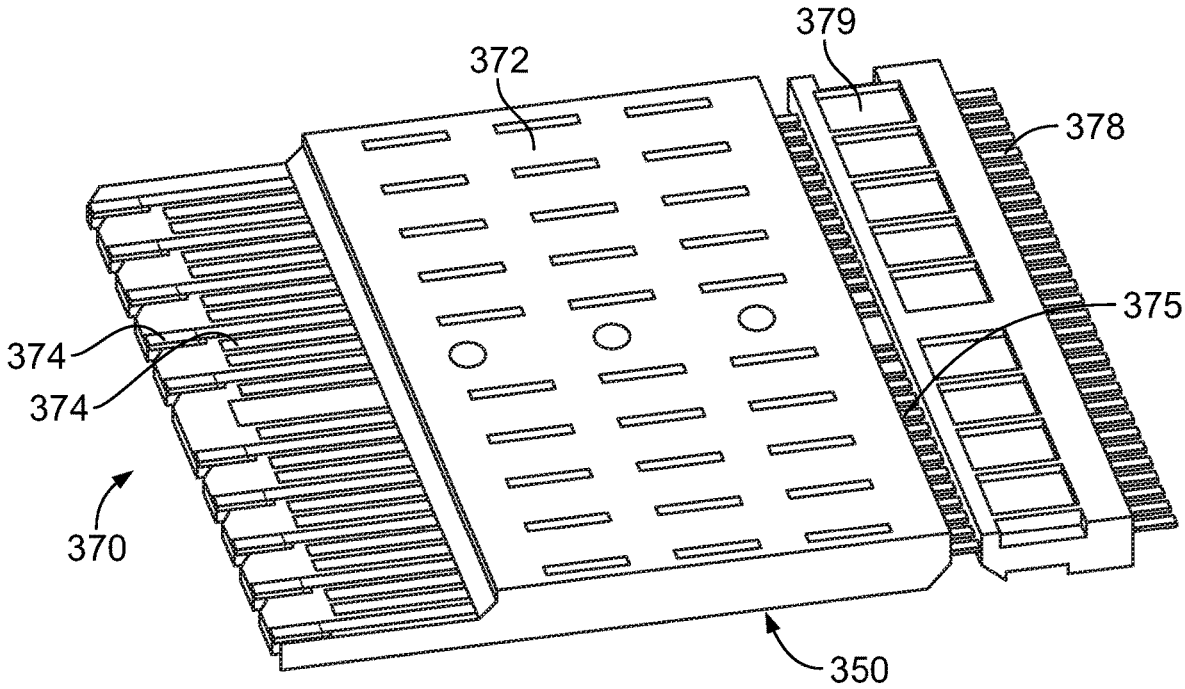
FIG. 12 is a top perspective view of the outer contact assembly in a flat state in accordance with an exemplary embodiment.

FIG. 12 is a top perspective view of the outer contact assembly 370 in a flat state. The outer frame 372 includes separate sections defining a portion of the platform 350 and the platform support 379. For example, the outer frame 372 may be overmolded over the leadframe in two separate sections. The transition portions 375 of the outer plug contacts 374 extend between the sections and may be bent during a forming process (for example, bent 90°). The mating ends 376 of the outer contacts are exposed along the top of the platform 350. The terminating ends 378 extend from the outer frame 372. The terminating ends 378 may be bent during a forming process (for example, bent 90°) to form the solder tails.

Figure 13:
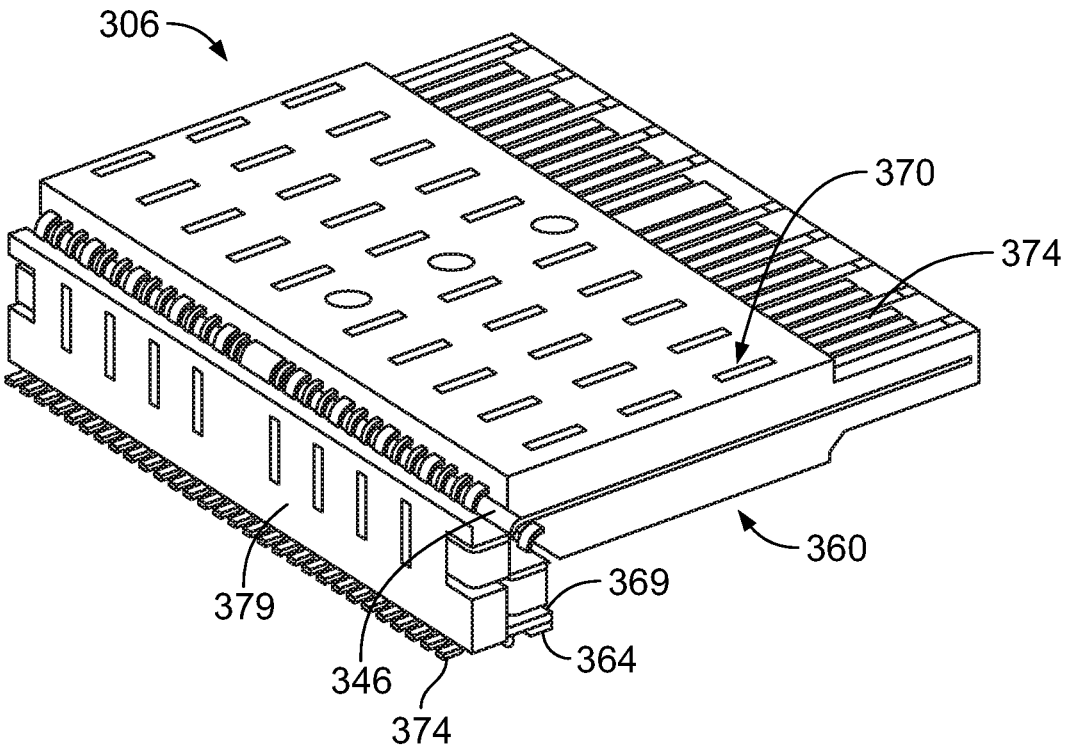
FIG. 13 is a front perspective view of the plug connector in accordance with an exemplary embodiment.

FIG. 13 is a front perspective view of the plug connector 306 in accordance with an exemplary embodiment. The inner and outer contact assemblies 360, 370 are formed into the right-angle configuration. For example, the inner and outer plug contacts 364, 374 are bent 90° between the platform 350 and the platform supports 369, 379. The inner and outer contact assemblies 360, 370 are coupled together with the ground plate 346 therebetween.

Figure 14:
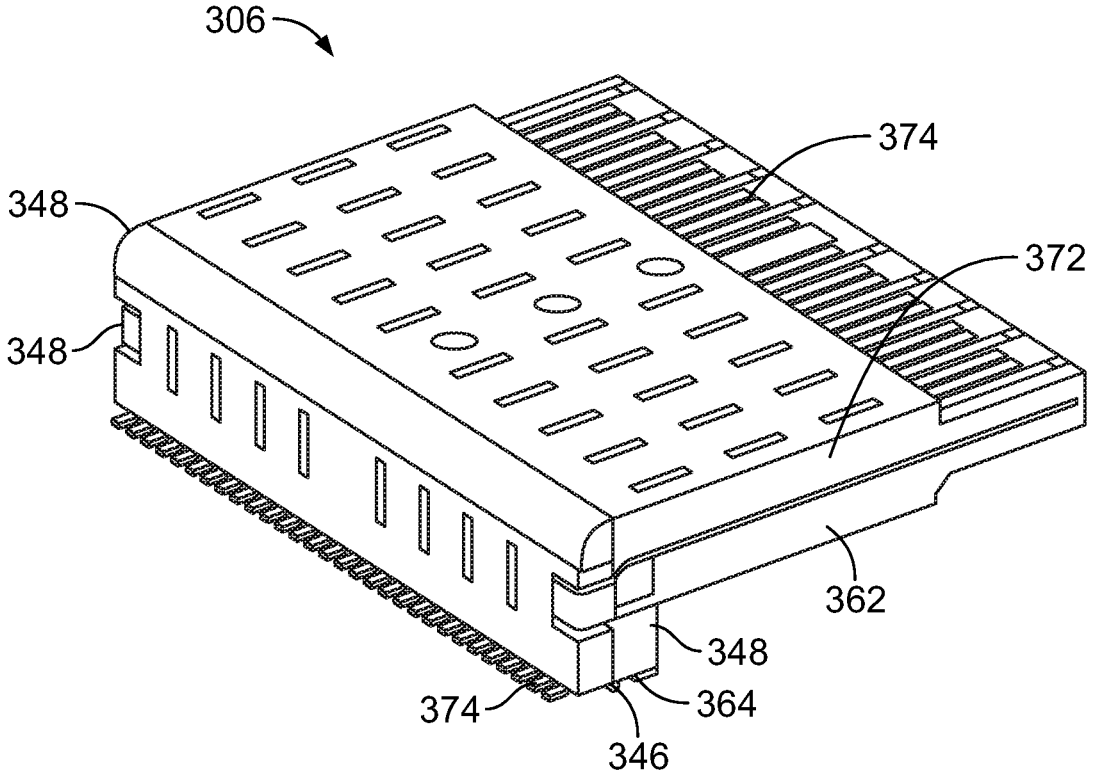
FIG. 14 is a front perspective view of the plug connector in accordance with an exemplary embodiment.

FIG. 14 is a front perspective view of the plug connector 306 in accordance with an exemplary embodiment. In an exemplary embodiment, the plug connector 306 includes encapsulation material 348 coupled to the inner frame 362 and the outer frame 372. For example, exposed portions of the inner plug contacts 364 and/or the outer plug contacts 374 and/or the ground plate 346 may be covered or encapsulated. The encapsulation material controls impedance of the signals along the signal paths. The type of material and the amount of encapsulation may be controlled to improve impedance mismatch along the signal paths. The encapsulant material may be a dielectric material, such as a plastic material. The encapsulant material may be a similar material as the material of the inner and outer frames 362, 372. The encapsulant material may entirely enclose the plug contacts 364, 374. The thickness of the encapsulant material may be similar to the thickness of the inner and outer frames 362, 372.

Figure 15:
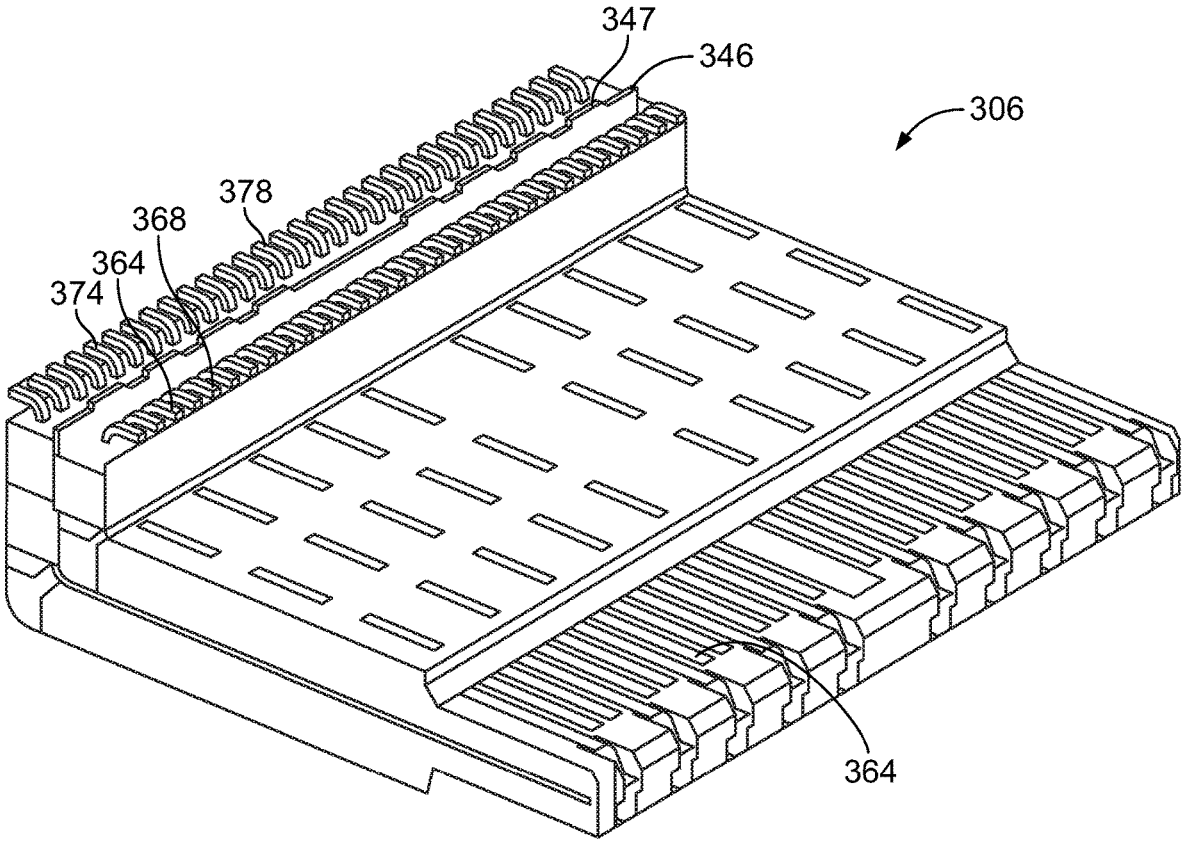
FIG. 15 is a rear perspective view of the plug connector in accordance with an exemplary embodiment.

FIG. 15 is a rear perspective view of the plug connector 306 in accordance with an exemplary embodiment. FIG. 15 shows the inner end of the plug connector 306, such as a bottom of the plug connector 306. The terminating ends 368, 378 of the inner and outer plug contacts 364, 374. The terminating ends 368, 378 may be bent in opposite directions (for example, rearward and forward, respectively). In an exemplary embodiment, the ground plate 346 is exposed along the inner end for termination to the module circuit board 304 (shown in FIG. 4). For example, the ground plate 346 includes solder tabs 347 along the inner end, which may be soldered to the ground pads 334 (FIG. 5) of the module circuit board 304.

Figure 16:
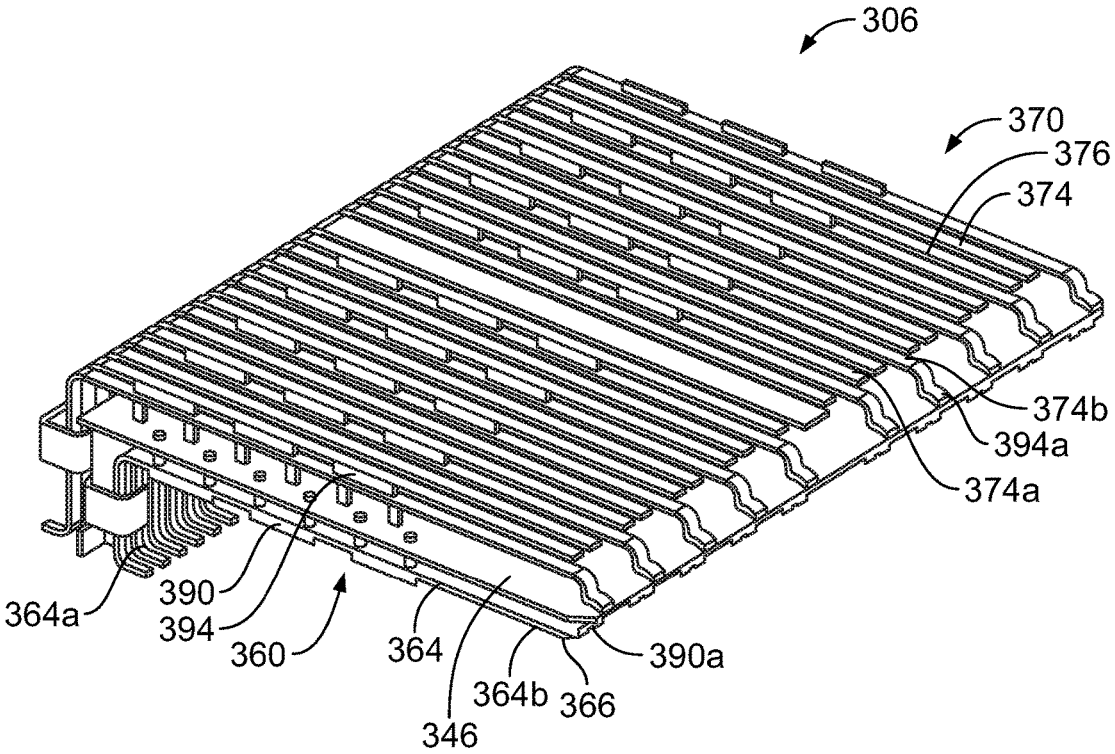
FIG. 16 is a rear perspective view of a portion of the plug connector in accordance with an exemplary embodiment.
Figure 17:
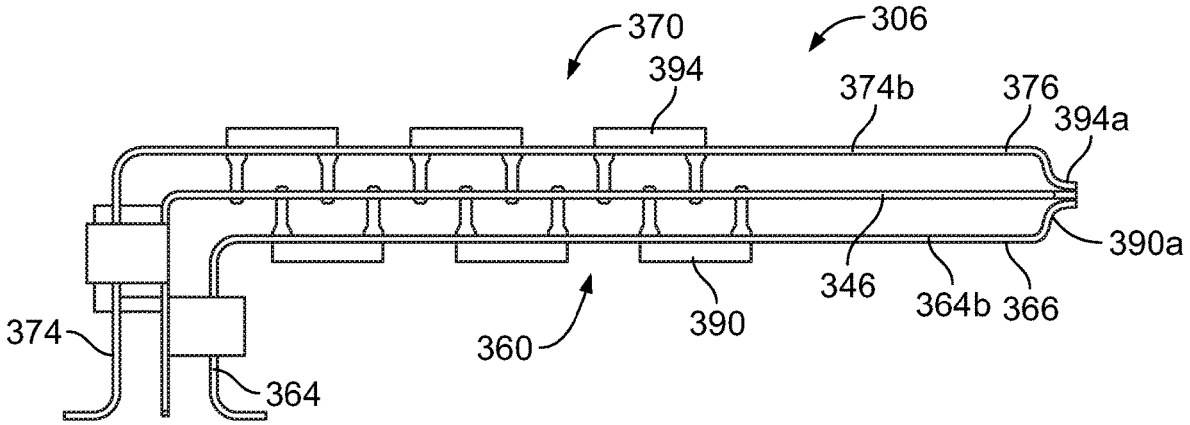
FIG. 17 is a side view of a portion of the plug connector in accordance with an exemplary embodiment.

FIG. 16 is a rear perspective view of a portion of the plug connector 306 in accordance with an exemplary embodiment. FIG. 17 is a side view of a portion of the plug connector 306 in accordance with an exemplary embodiment. FIGS. 16 and 17 show the leadframes of the inner and outer contact assemblies 360, 370 with the inner and outer frames 362, 372 (shown in FIG. 9) removed to illustrate the leadframes.

The inner plug contacts 364 are stamped and formed contacts. In various embodiments, the signal contacts 364 are arranged in pairs with the ground contacts 364 arranged between the pairs of signal contacts 364. In an exemplary embodiment, the inner ground plug contacts 364 include integral inner ground connecting tabs 390*a* at the mating ends 366. The integral inner ground connecting tabs 390*a* are stamped and formed with the inner ground plug contacts 364. The integral inner ground connecting tabs 390*a* directly engage the ground plate 346. The integral inner ground connecting tabs 390*a* may be soldered to the ground plate 346. The integral inner ground connecting tabs 390*a* form electrical paths between the inner ground plug contacts 364 and the ground plate 346 in addition to the U-shaped inner ground connecting tabs 390.

The outer plug contacts 374 are stamped and formed contacts. In various embodiments, the signal contacts 374 are arranged in pairs with the ground contacts 374 arranged between the pairs of signal contacts 374. In an exemplary embodiment, the outer ground plug contacts 374 include integral outer ground connecting tabs 394*a* at the mating ends 376. The integral outer ground connecting tabs 394*a* are stamped and formed with the outer ground plug contacts 374. The integral outer ground connecting tabs 394*a* directly engage the ground plate 346. The integral outer ground connecting tabs 394*a* may be soldered to the ground plate 346. The integral outer ground connecting tabs 394*a* form electrical paths between the outer ground plug contacts 374 and the ground plate 346 in addition to the U-shaped outer ground connecting tabs 394.

Figure 18:
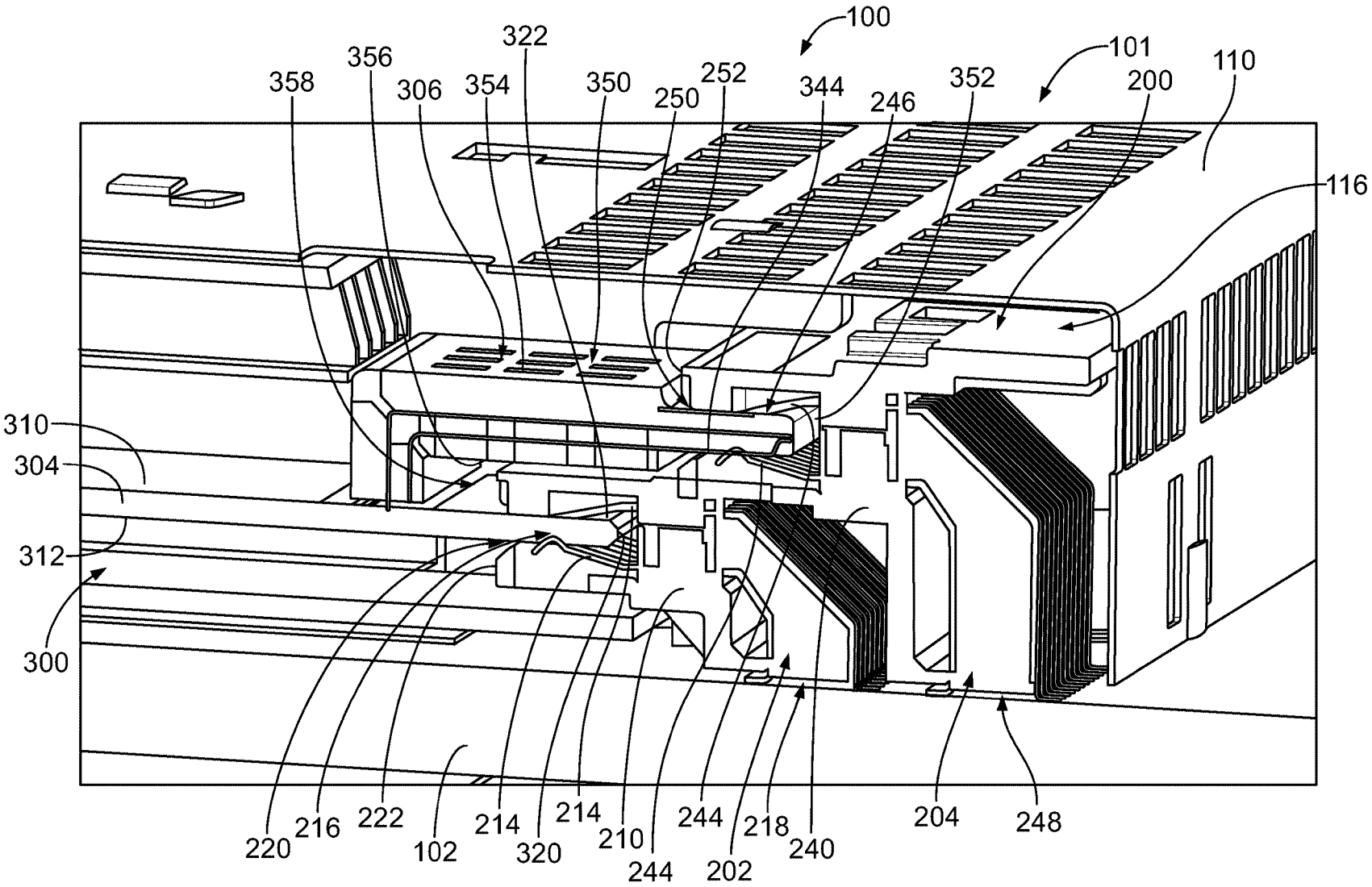
FIG. 18 is a cross sectional view of the communication system in accordance with an exemplary embodiment.

FIG. 18 is a cross sectional view of the communication system 100 in accordance with an exemplary embodiment. The pluggable module 300 is coupled to the circuit board assembly 101. For example, the pluggable module 300 is loaded into the module channel 116 in the receptacle cage 110 to mate with the communication connector 200.

The communication connector 200 includes the inner receptacle connector 202 and the outer receptacle connector 204. The inner receptacle connector 202 defines the inner mating interface 216 and the first signal paths for electrical connection with the module circuit board 304. The outer receptacle connector 204 defines the outer mating interface 246 and the second signal paths for electrical connection with the plug connector 306. The inner receptacle connector 202 is a right-angle connector. The inner contacts 214 are right-angle contacts extending between the inner mating interface 216 and the inner mounting interface 218. The inner contacts 214 include spring beams defining separable interfaces at the inner mating interface 216 and solder tails at the inner mounting interface 218 for termination to the circuit board 102. In an exemplary embodiment, the inner contacts 214 are arranged in two sets of inner contacts, such as an upper set and a lower set of inner contacts for interfacing with the mating pads 322 at the first surface 310 (upper surface) and the second surface 312 (lower surface). The outer receptacle connector 204 is a right-angle connector. The outer contacts 244 are right-angle contacts extending between the outer mating interface 246 and the outer mounting interface 248. The outer contacts 244 include spring beams defining separable interfaces at the outer mating interface 246 and solder tails at the outer mounting interface 248 for termination to the circuit board 102. In an exemplary embodiment, the outer contacts 244 are arranged in two sets of outer contacts, such as an upper set and a lower set of outer contacts for interfacing with the plug contacts 344 on the inner surface 354 and the outer surface 356 of the platform 350.

In an exemplary embodiment, the outer mating interface 246 is recessed relative to the inner mating interface 216. For example, the front 222 of the inner housing 210 is located forward of the front 252 of the outer housing 240. As such, the first slot 220 is located forward of the second slot 250. The plug connector 306 is mounted to the module circuit board 304 and defines a second plug interface. The platform 350 of the plug connector 306 is spaced apart from the module circuit board 304 and extends generally parallel to the module circuit board 304 (for example, both extend horizontally). The plug connector 306 extends rearward of the module circuit board 304. For example, the platform edge 352 is located rearward of the mating edge 320 of the module circuit board 304 for mating with the second slot 250 of the outer housing 240. A space 358 is defined between the platform 350 and the module circuit board 304. A portion of the inner housing 210 is received in the space 358.

Figure 19:
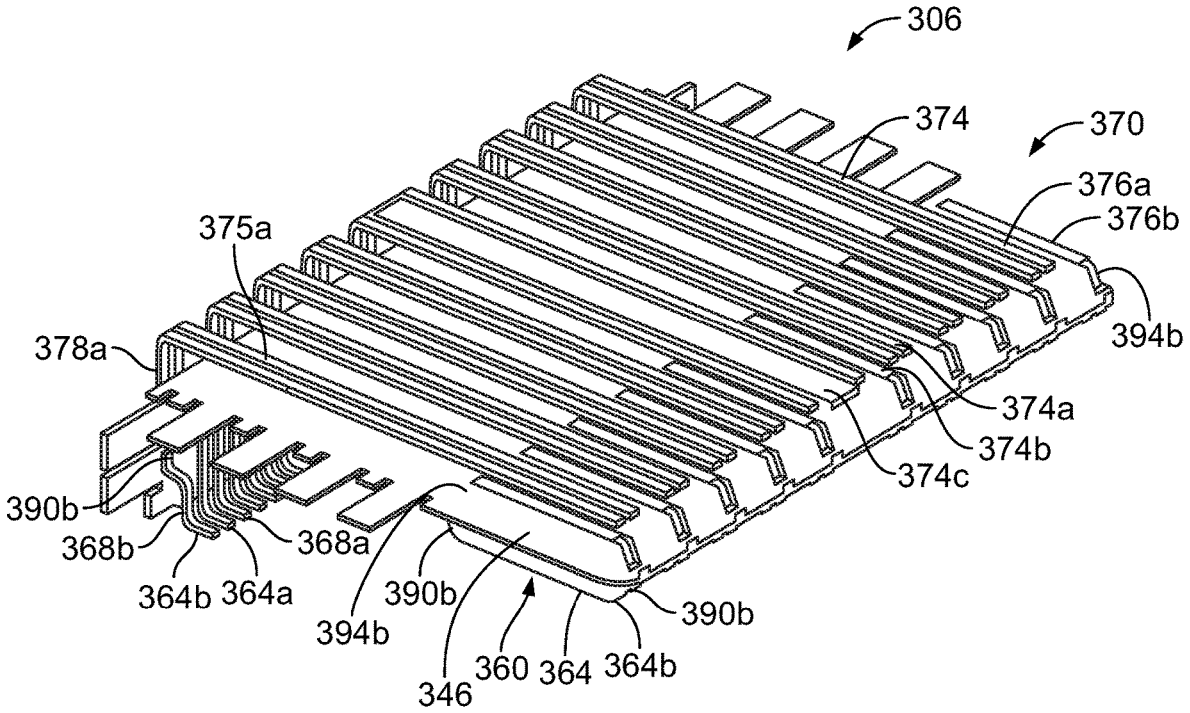
FIG. 19 is a rear perspective view of a portion of the plug connector in accordance with an exemplary embodiment.
Figure 20:
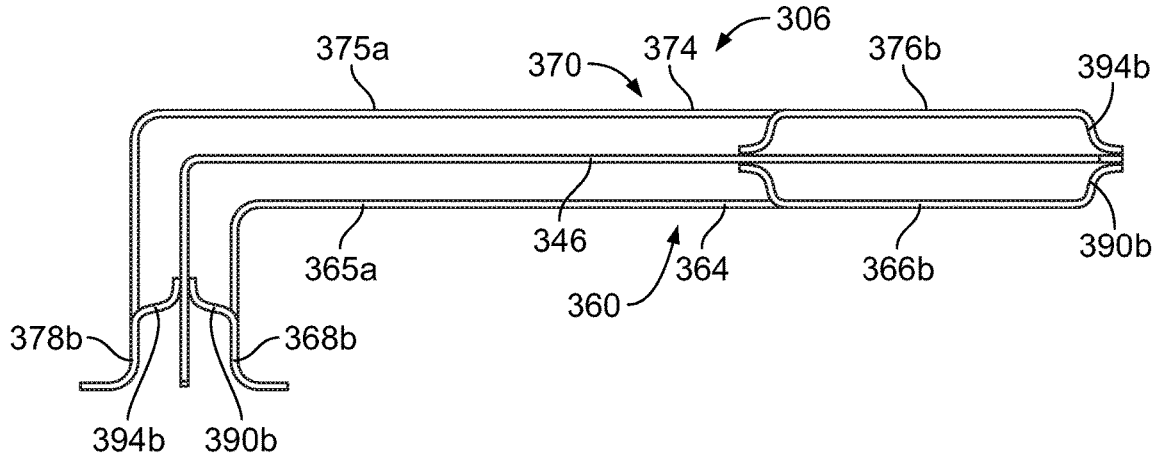
FIG. 20 is a side view of a portion of the plug connector in accordance with an exemplary embodiment.

FIG. 19 is a rear perspective view of a portion of the plug connector 306 in accordance with an exemplary embodiment. FIG. 20 is a side view of a portion of the plug connector 306 in accordance with an exemplary embodiment. FIGS. 19 and 20 show leadframes of the inner and outer contact assemblies 360, 370 with the inner and outer frames 362, 372 (shown in FIGS. 21-22) removed to illustrate the leadframes.

In an exemplary embodiment, the inner plug contacts 364 are stamped and formed contacts formed from a leadframe. The inner plug contacts 364 include signal contacts 364 and/or ground contacts 364 and/or power contacts 364*c*. In various embodiments, the signal contacts 364 are arranged in pairs with the ground contacts 364 arranged between the pairs of signal contacts 364. The signal contacts 364 includes the transition portions 365*a* between the mating end 366*a* and the terminating end 368*a*. However, in the illustrated embodiment, the ground contacts 364 are discontinuous. The ground contacts 364 do not include transition portions between the mating end 366*b* and the terminating end 368*b*. For example, the ground contacts 364 include ground mating pads at the mating end 366*b* and ground solder tails at the terminating end 368*b*.

In an exemplary embodiment, the inner ground plug contacts 364 include integral inner ground connecting tabs 390*b* at the ground mating ends 366*b* and the ground terminating ends 368*b*. The inner ground connecting tabs 390*b* are stamped and formed with the inner ground plug contacts 364. The inner ground connecting tabs 390*b* directly engage the ground plate 346. The inner ground connecting tabs 390*b* may be soldered to the ground plate 346. The inner ground connecting tabs 390*b* form electrical paths between the inner ground plug contacts 364 and the ground plate 346. The ground mating ends 366*b* and the ground terminating ends 368*b* are coupled to the ground plate 346 through the inner ground connecting tabs 390*b*. The ground mating ends 366*b* are electrically connected to the ground terminating ends 368*b* through the ground plate 346.

The transition portions 365*a* of the signal contacts 364 face each other between the mating end and the terminating end because the ground contacts 364 are discontinuous. For example, the ground plug contacts 364 do not extend between the signal transition portions 365*a*. The discontinuities in the ground contacts 364 leave gaps between the transition portions 365*a* of the signal contacts 364. Edges of the signal plug contacts 364 along the signal transition portions 365*a* face each other across the gaps. The signal plug contacts 364, which are arranged in pairs, are closely coupled by edge coupling or intrapair coupling, which reduces or eliminates resonances that would occur due to the discontinuity of the ground contacts and the ground planes. Edges of the ground plug contacts 364 face the edges of the signal plug contacts 364 along the signal mating ends 366*a* and the signal terminating ends 368*a* such that the ground plug contacts 364 provide electrical shielding between the signal plug contacts 364 at the signal mating ends 366*a* and the signal terminating ends 368*a*.

In an exemplary embodiment, the outer plug contacts 374 are stamped and formed contacts formed from a leadframe. The outer plug contacts 374 include signal contacts 374 and/or ground contacts 374 and/or power contacts 374*c*. In various embodiments, the signal contacts 374 are arranged in pairs with the ground contacts 374 arranged between the pairs of signal contacts 374. The signal contacts 374 includes the transition portions 375*a* between the mating end 376*a* and the terminating end 378*a*. However, in the illustrated embodiment, the ground contacts 374 are discontinuous. The ground contacts 374 do not include transition portions between the mating end 376*b* and the terminating end 378*b*. For example, the ground contacts 374 include ground mating pads at the mating end 376*b* and ground solder tails at the terminating end 378*b*.

In an exemplary embodiment, the outer ground plug contacts 374 include integral outer ground connecting tabs 394*b* at the ground mating ends 376*b* and the ground terminating ends 378*b*. The outer ground connecting tabs 394*b* are stamped and formed with the outer ground plug contacts 374. The outer ground connecting tabs 394*b* directly engage the ground plate 346. The outer ground connecting tabs 394*b* may be soldered to the ground plate 346. The outer ground connecting tabs 394*b* form electrical paths between the outer ground plug contacts 374 and the ground plate 346. The ground mating ends 376*b* and the ground terminating ends 378*b* are coupled to the ground plate 346 through the outer ground connecting tabs 394*b*. The ground mating ends 376*b* are electrically connected to the ground terminating ends 378*b* through the ground plate 346.

The transition portions 375*a* of the signal contacts 374 face each other between the mating end 376*a* and the terminating end 378*a* because the ground contacts 374 are discontinuous. For example, the ground plug contacts 374 do not extend between the signal transition portions 375*a*. The discontinuities in the ground contacts 374 leave gaps between the transition portions 375*a* of the signal contacts 374. Edges of the signal plug contacts 374 along the signal transition portions 375*a* face each other across the gaps. The signal plug contacts 374, which are arranged in pairs, are closely coupled by edge coupling or intrapair coupling, which reduces or eliminates resonances that would occur due to the discontinuity of the ground contacts and the ground planes. Edges of the ground plug contacts 374 face the edges of the signal plug contacts 374 along the signal mating ends 376*a* and the signal terminating ends 378*a* such that the ground plug contacts 374 provide electrical shielding between the signal plug contacts 374 at the signal mating ends 376*a* and the signal terminating ends 378*a*.

Figure 21:
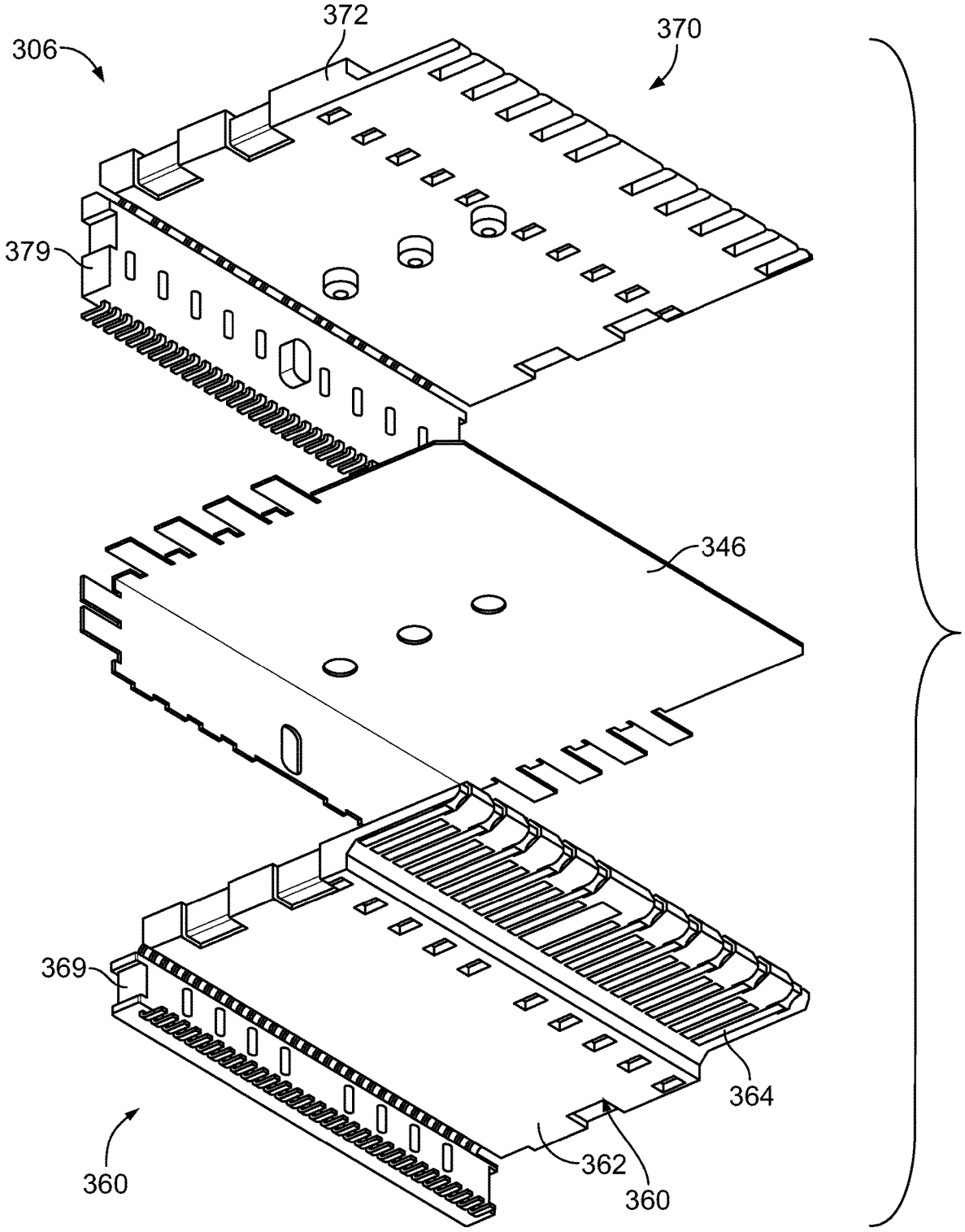
FIG. 21 is an exploded, rear perspective view of the plug connector in accordance with an exemplary embodiment.
Figure 22:
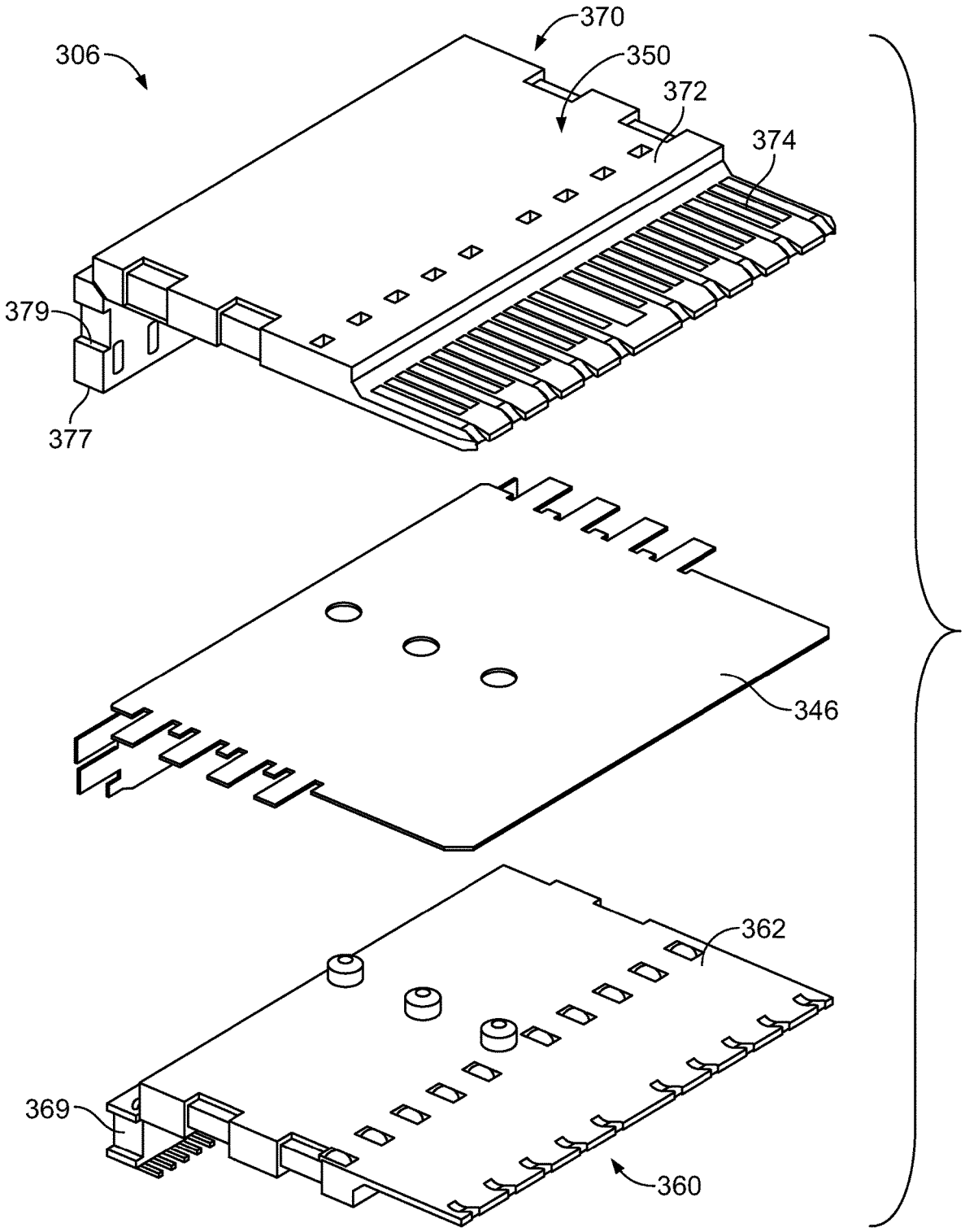
FIG. 22 is an exploded, front perspective view of the plug connector in accordance with an exemplary embodiment.

FIG. 21 is an exploded, rear perspective view of the plug connector 306 in accordance with an exemplary embodiment. FIG. 22 is an exploded, front perspective view of the plug connector 306 in accordance with an exemplary embodiment. FIGS. 21 and 22 illustrate the plug connector 306 using the inner and outer leadframes shown in FIGS. 19 and 20.

In the illustrated embodiment, the inner and outer contact assemblies 360, 370 are separate and discrete components. For example, the inner and outer contact assemblies 360, 370 are separately manufactured and then coupled together to form the plug connector 306. The ground plate 346 is located between the inner contact assembly 360 and the outer contact assembly 370. The inner contact assembly 360 includes the dielectric inner frame 362 holding the inner plug contacts 364. In an exemplary embodiment, the inner frame 362 is overmolded over the inner plug contacts 364 to form a portion of the platform 350 and the platform support 369. The inner ground connecting tabs 390*b* (FIG. 20) extend through the inner frame 362 for direct electrical connection with the ground plate 346. The outer contact assembly 370 includes the dielectric outer frame 372 holding the outer plug contacts 374. In an exemplary embodiment, the outer frame 372 is overmolded over the outer plug contacts 374 to form a portion of the platform 350 and the platform support 379. The outer ground connecting tabs 394*b* (FIG. 20) extend through the outer frame 372 for direct electrical connection with the ground plate 346.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "second," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A pluggable module comprising:

a pluggable body extending between a cable end and a mating end rearward of the cable end, the pluggable body having a module cavity;

a module circuit board received in the module cavity, the module circuit board having a mating edge at a mating end configured to be plugged into a first slot of a communication connector; and a plug connector extending between a plug mating end and a plug mounting end, the plug mounting end being mounted to the module circuit board, the plug connector including plug contacts extending between the plug mating end and the plug mounting end, the plug mating end configured to be plugged into a second slot of the communication connector to mate the plug contacts with the communication connector.

2. The pluggable module of claim 1, wherein the plug connector includes an inner contact assembly and an outer contact assembly with a ground plate between the inner contact assembly and the outer contact assembly, the inner contact assembly including a dielectric inner frame holding inner signal plug contacts of the plug contacts and inner ground plug contacts of the plug contacts, the outer contact assembly including a dielectric outer frame holding outer signal plug contacts of the plug contacts and outer ground plug contacts of the plug contacts.

3. The pluggable module of claim 2, wherein the plug connector includes inner ground connecting tabs electrically connecting the inner ground plug contacts to the ground plate at an inner connecting location remote from the plug mating end and remote from the plug mounting end, the plug connector including outer ground connecting tabs electrically connecting the outer ground plug contacts to the ground plate at an outer connecting location remote from the plug mating end and remote from the plug mounting end.

4. The pluggable module of claim 3, wherein the inner ground connecting tabs are separate and discrete from the ground plate and physically coupled thereto to make an electrical connection between the ground plate and the inner ground connecting tabs, and wherein the outer ground connecting tabs are separate and discrete from the ground plate and physically coupled thereto to make an electrical connection between the ground plate and the outer ground connecting tabs.

5. The pluggable module of claim 3, wherein each inner ground connecting tab includes a first arm having a first mating interface and a second arm having a second mating interface, the first and second mating interfaces of the inner ground connecting tab being separately coupled to the ground plate at different inner connecting locations, and wherein each outer ground connecting tab includes a first arm having a first mating interface and a second arm having a second mating interface, the first and second mating interfaces of the outer ground connecting tab being separately coupled to the ground plate at different outer connecting locations.

6. The pluggable module of claim 3, wherein the plug connector includes a plurality of the inner ground connecting tabs engaging each inner ground plug contact and a plurality of the outer ground connecting tabs engaging each outer ground plug contact.

7. The pluggable module of claim 3, wherein the inner ground connecting tabs shorten effective lengths of the inner ground plug contacts and wherein the outer ground connecting tabs shorten effective lengths of the outer ground plug contacts.

8. The pluggable module of claim 1, wherein the plug connector includes an inner contact assembly and an outer contact assembly with a ground plate between the inner contact assembly and the outer contact assembly, the inner contact assembly and the outer contact assembly including dielectric frames holding signal plug contacts and ground plug contacts, the signal plug contacts having signal mating ends at the plug mating end, signal terminating ends at the plug mounting end and signal transition portions between the signal mating ends and the signal terminating ends, the ground plug contacts having ground mating ends at the plug mating end and ground terminating ends at the plug mounting end, the ground plug contacts being discontinuous between the ground mating ends and the ground mounting ends, the ground mating ends and the ground terminating ends being coupled to the ground plate, the ground mating ends being electrically connected to the ground terminating ends through the ground plate.

9. The pluggable module of claim 8, wherein the ground plug contacts do not extend between the signal transition portions.

10. The pluggable module of claim 8, wherein the signal plug contacts include edges and the ground plug contacts include edges, the edges of the ground plug contacts facing the edges of the signal plug contacts and the signal mating ends and the signal terminating ends, the edges of the signal plug contacts facing the edges of other signal plug contacts along the signal transition portions.

11. The pluggable module of claim 8, wherein the ground mating ends include ground connecting tabs extending to and directly engaging the ground plate and the ground terminating ends include ground connecting tabs extending to and directly engaging the ground plate.

12. A pluggable module comprising:

a pluggable body extending between a cable end and a mating end rearward of the cable end, the pluggable body having a module cavity;

a module circuit board received in the module cavity, the module circuit board having a mating edge at a mating end configured to be plugged into a first slot of a communication connector; and a plug connector extending between a plug mating end and a plug mounting end, the plug mating end configured to be plugged into a second slot of the communication connector to mate the plug contacts with the communication connector, the plug mounting end being mounted to the module circuit board, the plug connector including an inner contact assembly and an outer contact assembly with a ground plate between the inner contact assembly and the outer contact assembly, the inner contact assembly including a dielectric inner frame holding inner signal plug contacts and inner ground plug contacts, the outer contact assembly including a dielectric outer frame holding outer signal plug contacts and outer ground plug contacts, the plug connector including inner ground connecting tabs electrically connecting the inner ground plug contacts to the ground plate at an inner connecting location remote from the plug mating end and remote from the plug mounting end, the plug connector including outer ground connecting tabs electrically connecting the outer ground plug contacts to the ground plate at an outer connecting location remote from the plug mating end and remote from the plug mounting end.

13. The pluggable module of claim 12, wherein the inner ground connecting tabs are separate and discrete from the ground plate and physically coupled thereto to make an electrical connection between the ground plate and the inner ground connecting tabs, and wherein the outer ground connecting tabs are separate and discrete from the ground plate and physically coupled thereto to make an electrical connection between the ground plate and the outer ground connecting tabs.

14. The pluggable module of claim 12, wherein each inner ground connecting tab includes a first arm having a first mating interface and a second arm having a second mating interface, the first and second mating interfaces of the inner ground connecting tab being separately coupled to the ground plate at different inner connecting locations, and wherein each outer ground connecting tab includes a first arm having a first mating interface and a second arm having a second mating interface, the first and second mating interfaces of the outer ground connecting tab being separately coupled to the ground plate at different outer connecting locations.

15. The pluggable module of claim 12, wherein the plug connector includes a plurality of the inner ground connecting tabs engaging each inner ground plug contact and a plurality of the outer ground connecting tabs engaging each outer ground plug contact.

16. The pluggable module of claim 12, wherein the inner ground connecting tabs shorten effective lengths of the discontinuity between the inner ground plug contacts and the ground plane and wherein the outer ground connecting tabs shorten effective lengths of the discontinuity between the outer ground plug contacts and the center ground plane.

17. A pluggable module comprising:

a pluggable body extending between a cable end and a mating end rearward of the cable end, the pluggable body having a module cavity;

a module circuit board received in the module cavity, the module circuit board having a mating edge at a mating end configured to be plugged into a first slot of a communication connector; and a plug connector extending between a plug mating end and a plug mounting end, the plug mating end configured to be plugged into a second slot of the communication connector to mate the plug contacts with the communication connector, the plug mounting end being mounted to the module circuit board, the plug connector including an inner contact assembly and an outer contact assembly with a ground plate between the inner contact assembly and the outer contact assembly, the inner contact assembly and the outer contact assembly including dielectric frames holding signal plug contacts and ground plug contacts, the signal plug contacts having signal mating ends at the plug mating end, signal terminating ends at the plug mounting end and signal transition portions between the signal mating ends and the signal terminating ends, the ground plug contacts having ground mating ends at the plug mating end and ground terminating ends at the plug mounting end, the ground plug contacts being discontinuous between the ground mating ends and the ground mounting ends, the ground mating ends and the ground terminating ends being coupled to the ground plate, the ground mating ends being electrically connected to the ground terminating ends through the ground plate.

18. The pluggable module of claim 17, wherein the ground plug contacts do not extend between the signal transition portions.

19. The pluggable module of claim 17, wherein the signal plug contacts include edges and the ground plug contacts include edges, the edges of the ground plug contacts facing the edges of the signal plug contacts and the signal mating ends and the signal terminating ends, the edges of the signal plug contacts facing the edges of other signal plug contacts along the signal transition portions.

20. The pluggable module of claim 17, wherein the ground mating ends include ground connecting tabs extending to and directly engaging the ground plate and the ground terminating ends include ground connecting tabs extending to and directly engaging the ground plate.

* * * * *